US012529507B2

(12) United States Patent
Bae et al.

(10) Patent No.: US 12,529,507 B2
(45) Date of Patent: Jan. 20, 2026

(54) VACUUM ADIABATIC BODY, REFRIGERATOR, AND METHOD FOR FABRICATING THE REFRIGERATOR

(71) Applicant: LG ELECTRONICS INC., Seoul (KR)

(72) Inventors: Jaehyun Bae, Seoul (KR); Wonyeong Jung, Seoul (KR); Deokhyun Youn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/762,943

(22) Filed: Jul. 3, 2024

(65) Prior Publication Data

US 2024/0361070 A1 Oct. 31, 2024

Related U.S. Application Data

(63) Continuation of application No. 17/619,969, filed as application No. PCT/KR2020/008969 on Jul. 8, 2020, now Pat. No. 12,055,343.

(30) Foreign Application Priority Data

Jul. 9, 2019 (KR) ..... 10-2019-0082640

(51) Int. Cl.
*F25D 23/06* (2006.01)
*F25D 11/02* (2006.01)
(Continued)

(52) U.S. Cl.
CPC ..... *F25D 23/068* (2013.01); *F25D 11/02* (2013.01); *F25D 23/028* (2013.01);
(Continued)

(58) Field of Classification Search
CPC ..... F25D 23/068; F25D 11/02; F25D 23/028; F25D 23/063; F25D 23/087;
(Continued)

(56) References Cited

U.S. PATENT DOCUMENTS 1,561,769 A 11/1925 Ballew
3,572,049 A 3/1971 Moorman
(Continued)

FOREIGN PATENT DOCUMENTS

CN 103968196 8/2014
CN 107850375 3/2018
(Continued)

OTHER PUBLICATIONS

International Search Report and Written Opinion dated Sep. 28, 2020 issued in PCT Application No. PCT/KR2020/008969.
(Continued)

*Primary Examiner* — Hanh V Tran
(74) *Attorney, Agent, or Firm* — KED & ASSOCIATES

(57) ABSTRACT

Provided is a vacuum adiabatic body. The vacuum adiabatic body includes a thin pipe passing through the main body to connect an inside of the accommodation space to an outside of the accommodation portion, a drain pipe provided inside the thin pipe to discharge the defrosting water, and an adiabatic material having an extension extending along the drain pipe to block heat transfer between the drain pipe and the thin pipe and a head provided at one side of both sides of the extension, which is close to the accommodation space.

20 Claims, 19 Drawing Sheets

(51) Int. Cl.
*F25D 23/02* (2006.01)
*F25D 23/08* (2006.01)

(52) U.S. Cl.
CPC ..... *F25D 23/063* (2013.01); *F25D 23/087* (2013.01); *F25D 2201/14* (2013.01)

(58) Field of Classification Search
CPC ..... F25D 2201/14; F25D 2321/146; F25D 23/065; F25D 21/14; F25D 23/06
See application file for complete search history.

(56) References Cited

U.S. PATENT DOCUMENTS

| | | | | |
|---|---|---|---|---|
| 4,165,105 | A | 8/1979 | Hahn | |
| 4,186,945 | A | 2/1980 | Hahn | |
| 4,805,293 | A | 2/1989 | Buchser | |
| 4,843,835 | A | 7/1989 | Goetz | |
| 5,000,010 | A | 3/1991 | Powell | |
| 5,317,924 | A | 6/1994 | Maack | |
| 6,224,179 | B1 | 5/2001 | Wenning | |
| 7,641,298 | B2 | 1/2010 | Hirath | |
| 8,490,353 | B2 | 7/2013 | Beele | |
| 8,857,931 | B2 | 10/2014 | Jung | |
| 9,863,689 | B2 | 1/2018 | Lee et al. | |
| 11,428,456 | B2 | 8/2022 | Jung | |
| 11,592,137 | B2 | 2/2023 | Jung | |
| 2004/0226956 | A1* | 11/2004 | Brooks | F25D 23/06 220/592.02 |
| 2006/0076863 | A1 | 4/2006 | Echigoya | |
| 2009/0241485 | A1 | 10/2009 | Diebold | |
| 2009/0324871 | A1 | 12/2009 | Henn | |
| 2011/0146330 | A1 | 6/2011 | Kuehl | |
| 2012/0104923 | A1 | 5/2012 | Jung | |
| 2013/0256319 | A1 | 10/2013 | Kuchl | |
| 2015/0159934 | A1 | 6/2015 | Choi | |
| 2016/0084568 | A1 | 3/2016 | Jung | |
| 2017/0130960 | A1 | 5/2017 | Nagano | |
| 2018/0224198 | A1 | 8/2018 | Jung et al. | |
| 2019/0024968 | A1 | 1/2019 | Jung et al. | |

FOREIGN PATENT DOCUMENTS

| | | | |
|---|---|---|---|
| CN | 107923699 | | 4/2018 |
| CN | 208134978 | | 11/2018 |
| FR | 2405413 | A1 | 5/1979 |
| JP | 60-137293 | | 9/1985 |
| JP | 2506036 | B2 | 6/1996 |
| JP | 11-132639 | | 5/1999 |
| JP | 2001-056174 | | 2/2001 |
| JP | 2004-190880 | | 7/2004 |
| JP | 2011-196581 | | 10/2011 |
| JP | 2011-257045 | A | 12/2011 |
| KR | 20-1998-0020939 | | 7/1998 |
| KR | 1999-0013159 | | 2/1999 |
| KR | 20-1999-0039047 | | 11/1999 |
| KR | 10-0343719 | | 7/2002 |
| KR | 10-2003-0058179 | | 7/2003 |
| KR | 20-0329820 | | 10/2003 |
| KR | 100595433 | B1 | 7/2006 |
| KR | 10-2013-0048529 | | 5/2013 |
| KR | 10-2015-0012712 | | 2/2015 |
| KR | 10-2017-0016187 | | 2/2017 |
| KR | 10-2017-0016243 | | 2/2017 |
| KR | 10-2017-0016647 | | 2/2017 |
| KR | 10-2019-0070787 | | 6/2019 |
| KR | 10-2019-0070791 | | 6/2019 |
| KR | 10-2019-0076939 | | 7/2019 |
| RU | 2537196 | | 12/2014 |
| RU | 2553251 | | 6/2015 |
| WO | WO 2017/023075 | A1 | 2/2017 |
| WO | WO 2017/023102 | A1 | 2/2017 |
| WO | WO 2018/047624 | A1 | 3/2018 |
| WO | WO 2018/111235 | A1 | 6/2018 |
| WO | WO 2020/004954 | | 1/2020 |

OTHER PUBLICATIONS

European Search Report dated Jun. 15, 2023 issued in Application No. 20836771.4.

Chinese Office Action dated Mar. 30, 2023 issued in Application No. 202080045136.8.

Chinese Office Action dated Sep. 8, 2023 issued in Application No. 202080045136.8.

Russian Office Action dated Jul. 8, 2020 issued in Application No. 2022102922/10(006297).

Korean Notice of Allowance dated Sep. 1, 2025.

* cited by examiner

VACUUM ADIABATIC BODY, REFRIGERATOR, AND METHOD FOR FABRICATING THE REFRIGERATOR

CROSS-REFERENCE TO RELATED APPLICATIONS

This application is a Continuation Application of U.S. patent application Ser. No. 17/619,969 filed Dec. 16, 2021, which is a U.S. National Stage Application under 35 U.S.C. § 371 of PCT Application No. PCT/KR2020/008969, filed Jul. 8, 2020, which claims priority to Korean Patent Application No. 10-2019-0082640, filed Jul. 9, 2019, whose entire disclosures are hereby incorporated by reference.

BACKGROUND

1. Field

The present disclosure relates to a vacuum adiabatic body, a refrigerator, and a method for fabricating the refrigerator.

2. Background

A vacuum adiabatic body is a product for suppressing heat transfer by vacuuming the inside of a main body thereof. The vacuum adiabatic body may reduce heat transfer by convection and conduction, and hence is applied to heating apparatuses and refrigerating apparatuses. In a typical adiabatic method applied to a refrigerator, although it is differently applied in refrigeration and freezing, a foam urethane adiabatic wall having a thickness of about 30 cm or more is generally provided. However, the internal volume of the refrigerator is therefore reduced.

In order to increase the internal volume of a refrigerator, there is an attempt to apply a vacuum adiabatic body to the refrigerator.

First, Korean Patent No. 10-0343719 (Reference Document 1) of the present applicant has been disclosed. According to Reference Document 1, there is disclosed a method in which a vacuum adiabatic panel is prepared and then built in walls of a refrigerator, and the outside of the vacuum adiabatic panel is finished with a separate molding as Styrofoam. According to the method, additional foaming is not required, and the adiabatic performance of the refrigerator is improved. However, fabrication cost is increased, and a fabrication method is complicated.

As another example, a technique of providing walls using a vacuum adiabatic material and additionally providing adiabatic walls using a foam filling material has been disclosed in Korean Patent Publication No. 10-2015-0012712 (Reference Document 2). According to Reference Document 2, fabrication cost is increased, and a fabrication method is complicated.

As further another example, there is an attempt to fabricate all walls of a refrigerator using a vacuum adiabatic body that is a single product. For example, a technique of providing an adiabatic structure of a refrigerator to be in a vacuum state has been disclosed in U.S. Patent Laid-Open Publication No. US2004/0226956A1 (Reference Document 3). However, it is difficult to obtain a practical level of an adiabatic effect by providing a wall of the refrigerator with sufficient vacuum. In detail, there are limitations that it is difficult to prevent a heat transfer phenomenon at a contact portion between an outer case and an inner case having different temperatures, it is difficult to maintain a stable vacuum state, and it is difficult to prevent deformation of a case due to a negative pressure of the vacuum state. Due to these limitations, the technology disclosed in Reference Document 3 is limited to a cryogenic refrigerator, and does not provide a level of technology applicable to general households.

Alternatively, the present applicant has applied for Korean Patent Publication No. 10-2017-0016187 (Reference Document 4) that discloses a vacuum adiabatic body and a refrigerator. According to the present disclosure, both the door and the main body of the refrigerator are provided as a vacuum adiabatic body, and a large adiabatic material is added to the edge of the door to prevent cool air from leaking from the edge of the main body and the door. However, there is a limitation in that the fabrication is complicated, and an internal volume of the refrigerator is greatly reduced.

An evaporator is provided in the refrigerator, and frost is thickly generated on the evaporator according to the cumulative use of the evaporator. Since the frost of the evaporator adversely affects performance of the evaporator, it is periodically melted and removed. Here, the removing of the frost from the evaporator is called a defrosting operation. Defrosting water generated during the defrosting operation is discharged to the outside of the refrigerator.

As a technique for discharging the defrosting water to the outside of the refrigerator, U.S. Pat. No. 9,863,689B2 (Reference Document 5) has been suggested. In Reference Document 5, a hose for discharging defrosting water and a valve for opening and closing the hose are provided outside the refrigerator. The hose passes through a foam adiabatic material and then is guided to the outside.

The techniques of Reference Document 5 may be applied in the case of a refrigerator using a foam. Specifically, the refrigerator using the foam uses an adiabatic portion having a thickness of several tens of centimeters. On the other hand, when the refrigerator uses a vacuum adiabatic body, the adiabatic portion having a thickness of only a few tens of millimeters is used even though the adiabatic portion is thick. In addition, when using the foam and when using the vacuum adiabatic body, there are many differences such as a vacuum degree and material differences.

Due to such a structural difference, in the case of the refrigerator using the vacuum adiabatic body, there is a limitation that a large amount of cool air is lost through a gap between a discharge structures of the defrosting water because the thin thickness.

In the case of the refrigerator using the vacuum adiabatic body, there is a limitation in that a conduction cooling loss between the portions is large because vacuum is provided by a metal connection body and their welding.

In the refrigerator using the vacuum adiabatic body, a large amount of cool air is permeated due to the small thickness. In this case, there is a limitation that malfunction occurs due to freezing of the defrosting water.

In the case of the refrigerator using the vacuum adiabatic body, a temperature change is large due to the metal structure and dew generated around the metal structure due to the temperature change during the defrosting operation adversely affect reliability of the product.

BRIEF DESCRIPTION OF THE DRAWINGS

The embodiments will be described in detail with reference to the following drawings in which like reference numerals refer to like elements wherein:

FIGS. 11A to 13 are views for explaining an effect of a wrinkle pipe adiabatic material according to an embodiment, wherein FIG. 11 is a view comparing a case in which a head is provided on one end of the wrinkle pipe adiabatic material to a case in which a head is provided on all of both ends of the wrinkle pipe adiabatic material according to an embodiment, FIG. 12 is a view illustrating a conduction heat flow between the plates, and FIG. 13 is a view comparing a temperature change for points of the drain according to an adiabatic manner.

DETAILED DESCRIPTION

Hereinafter, exemplary embodiments will be described with reference to the accompanying drawings. The invention may, however, be embodied in many different forms and should not be construed as being limited to the embodiments set forth herein, and a person of ordinary skill in the art, who understands the spirit of the present invention, may readily implement other embodiments included within the scope of the same concept by adding, changing, deleting, and adding components; rather, it will be understood that they are also included within the scope of the present invention.

The drawings shown below may be displayed differently from the actual product, or exaggerated or simple or detailed components may be deleted, but this is intended to facilitate understanding of the technical idea of the present invention. It should not be construed as limited. However, it will try to show the actual shape as much as possible.

The following embodiments may be applied to the description of another embodiment unless the other embodiment does not collide with each other, and some configurations of any one of the embodiments may be modified in a state in which only a specific portion is modified in another configuration may be applied.

In the following description, the vacuum pressure means any pressure state lower than the atmospheric pressure. In addition, the expression that a vacuum degree of A is higher than that of B means that a vacuum pressure of A is lower than that of B.

Figure 1:
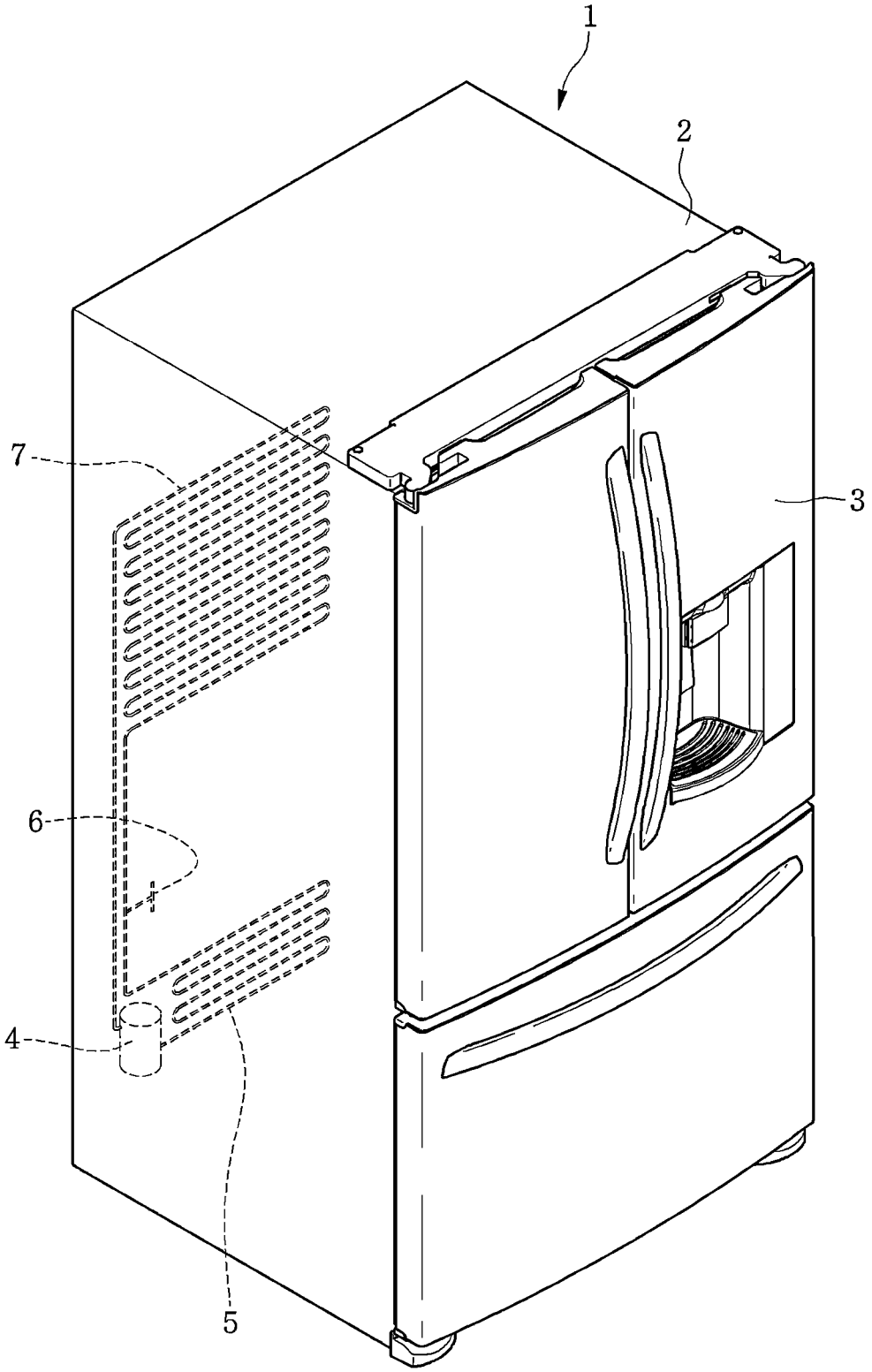
FIG. 1 is a perspective view of a refrigerator according to an embodiment.

FIG. 1 is a perspective view of a refrigerator according to an embodiment.

Referring to FIG. 1, the refrigerator 1 includes a main body 2 provided with a cavity 9 capable of storing storage goods and a door 3 provided to open and close the main body 2. The door 3 may be rotatably or slidably movably disposed to open/close the cavity 9. The cavity 9 may provide at least one of a refrigerating compartment and a freezing compartment.

Components constituting a refrigeration cycle in which cool air is supplied into the cavity 9. In detail, the components include a compressor 4 for compressing a refrigerant, a condenser 5 for condensing the compressed refrigerant, an expander 6 for expanding the condensed refrigerant, and an evaporator 7 for evaporating the expanded refrigerant to take heat. As a typical structure, a fan may be installed at a position adjacent to the evaporator 7, and a fluid blown from the fan may pass through the evaporator 7 and then be blown into the cavity 9. A freezing load is controlled by adjusting the blowing amount and blowing direction by the fan, adjusting the amount of a circulated refrigerant, or adjusting the compression rate of the compressor, so that it is possible to control a refrigerating space or a freezing space.

Figure 2:
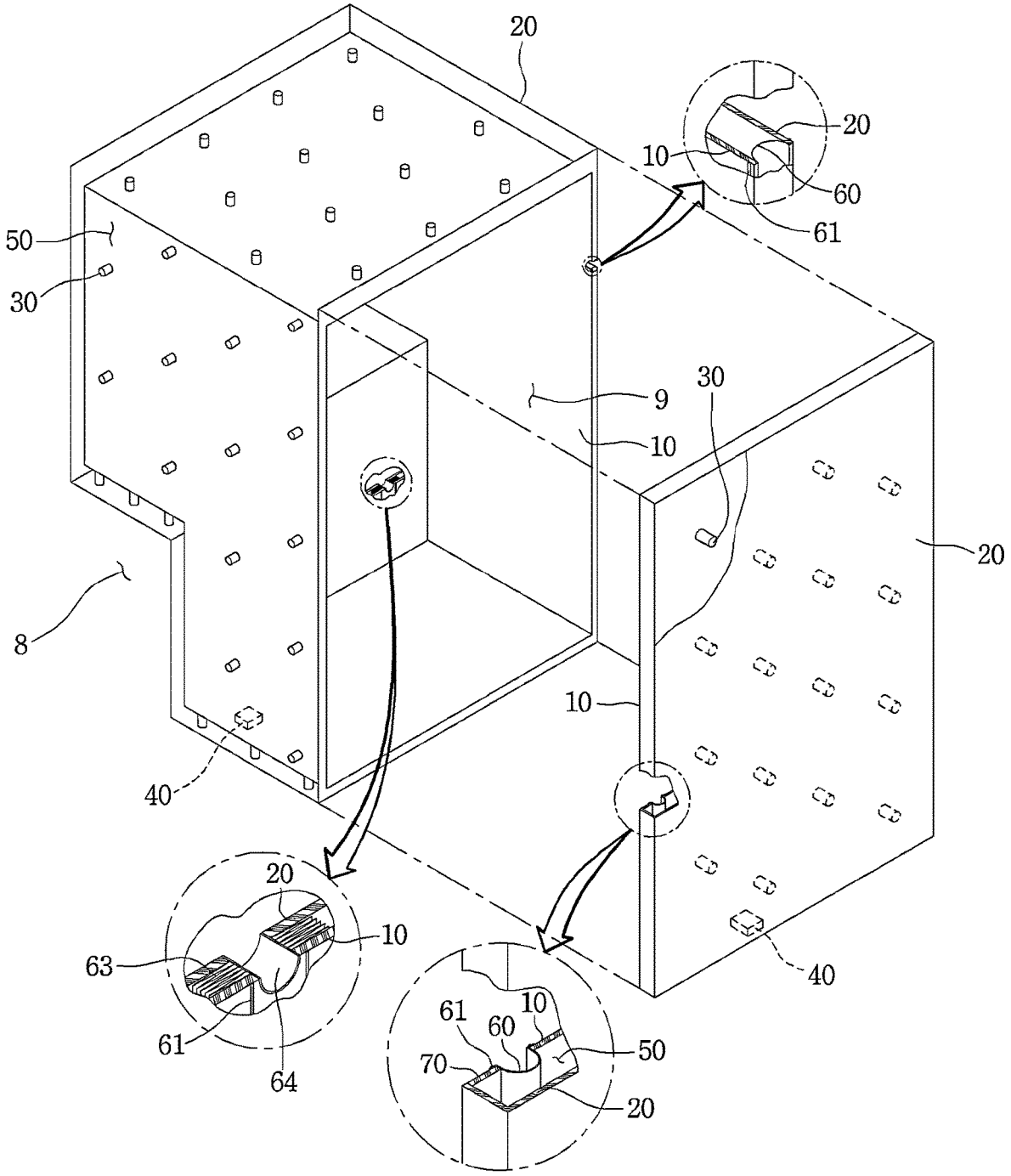
FIG. 2 is a view schematically showing a vacuum adiabatic body used in a main body and a door of the refrigerator.

FIG. 2 is a view schematically illustrating a vacuum adiabatic body used in the main body and the door of the refrigerator. In FIG. 2, a main body-side vacuum adiabatic body is illustrated in a state in which walls of top and side surfaces are removed, and a door-side vacuum adiabatic body is illustrated in a state in which a portion of a wall of a front surface is removed. In addition, sections of portions at conductive resistance sheets are provided are schematically illustrated for convenience of understanding.

Referring to FIG. 2, the vacuum adiabatic body includes a first plate 10 for providing a wall of a low-temperature space, a second plate 20 for providing a wall of a high-temperature space, a vacuum space 50 defined as a gap between the first and second plates 10 and 20. Also, the vacuum adiabatic body includes the conductive resistance sheets 60 and 63 for preventing thermal conduction between the first and second plates 10 and 20. A seal 61 for sealing the first and second plates 10 and 20 is provided so that the vacuum space 50 is in a sealing state. When the vacuum adiabatic body is applied to a refrigerator or a heating cabinet, the first plate 10 may be referred to as an inner case, and the second plate 20 may be referred to as an outer case. A machine room 8 in which components providing a refrigeration cycle are accommodated is placed at a lower rear side of the main body-side vacuum adiabatic body, and an exhaust port 40 for forming a vacuum state by exhausting air in the vacuum space 50 is provided at any one side of the vacuum adiabatic body. In addition, a pipeline 64 passing through the vacuum space 50 may be further installed so as to install a defrosting water line and electric wires.

The first plate 10 may define at least a portion of a wall for a first space provided thereto. The second plate 20 may define at least a portion of a wall for a second space provided thereto. The first space and the second space may be defined as spaces having different temperatures. Here, the wall for each space may serve as not only a wall directly contacting the space but also a wall not contacting the space. For example, the vacuum adiabatic body of the embodiment may also be applied to a product further having a separate wall contacting each space.

Factors of heat transfer, which cause loss of the adiabatic effect of the vacuum adiabatic body, are thermal conduction between the first and second plates 10 and 20, heat radiation between the first and second plates 10 and 20, and gas conduction of the vacuum space 50.

Hereinafter, a heat resistance unit provided to reduce adiabatic loss related to the factors of the heat transfer will be provided. Meanwhile, the vacuum adiabatic body and the refrigerator of the embodiment do not exclude that another adiabatic means is further provided to at least one side of the vacuum adiabatic body. Therefore, an adiabatic means using foaming or the like may be further provided to another side of the vacuum adiabatic body.

FIG. 3 is a view illustrating an internal configuration of the vacuum space according to various embodiments.

Figure 3A:
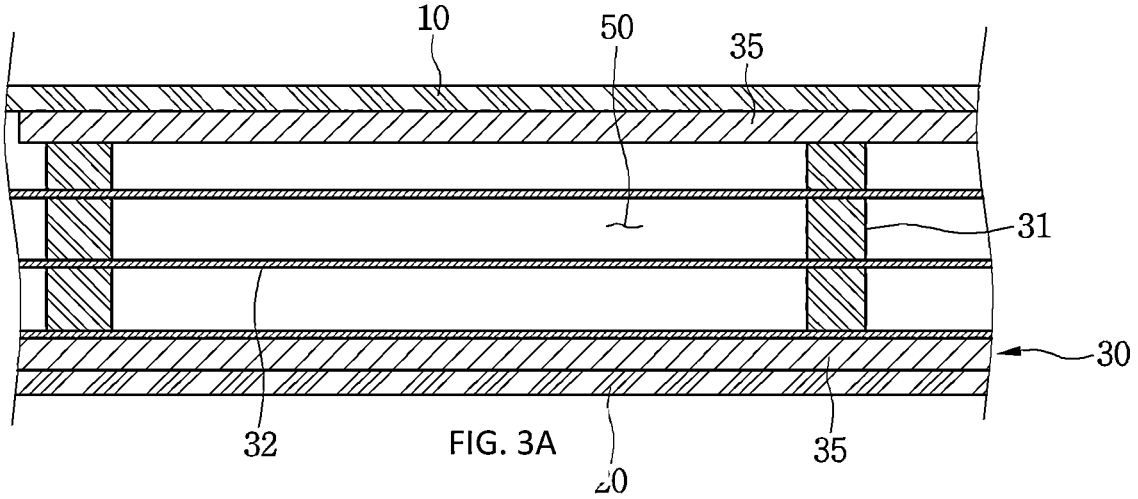
FIGS. 3A-3C are views illustrating an internal configuration of a vacuum space according to various embodiments.

First, referring to FIG. 3A, the vacuum space 50 may be provided in a third space having a pressure different from that of each of the first and second spaces, preferably, a vacuum state, thereby reducing an adiabatic loss. The third space may be provided at a temperature between the temperature of the first space and the temperature of the second space. Since the third space is provided as a space in the vacuum state, the first and second plates 10 and 20 receive a force contracting in a direction in which they approach each other due to a force corresponding to a pressure difference between the first and second spaces. Therefore, the vacuum space 50 may be deformed in a direction in which the vacuum space 50 is reduced in volume. In this case, the adiabatic loss may be caused due to an increase in amount of heat radiation, caused by the contraction of the vacuum space 50, and an increase in amount of thermal conduction, which is caused by contact between the plates 10 and 20.

The support 30 may be provided to reduce the deformation of the vacuum space 50. The support 30 includes a bar 31. The bar 31 may extend in a substantially vertical direction with respect to the plates to support a distance between the first plate and the second plate. A support plate 35 may be additionally provided on at least any one end of the bar 31. The support plate 35 may connect at least two or more bars 31 to each other to extend in a horizontal direction with respect to the first and second plates 10 and 20. The support plate 35 may be provided in a plate shape or may be provided in a lattice shape so that an area of the support plate contacting the first or second plate 10 or 20 decreases, thereby reducing heat transfer. The bars 31 and the support plate 35 are fixed to each other at at least a portion so as to be inserted together between the first and second plates 10 and 20. The support plate 35 contacts at least one of the first and second plates 10 and 20, thereby preventing the deformation of the first and second plates 10 and 20. In addition, based on the extension direction of the bars 31, a total sectional area of the support plate 35 is provided to be greater than that of the bars 31, so that heat transferred through the bars 31 may be diffused through the support plate 35.

The support 30 may be made of a resin selected from PC, glass fiber PC, low outgassing PC, PPS, and LCP to obtain high compressive strength, a low outgassing and water absorption rate, low thermal conductivity, high compressive strength at a high temperature, and superior processability.

A radiation resistance sheet 32 for reducing heat radiation between the first and second plates 10 and 20 through the vacuum space 50 will be described. The first and second plates 10 and 20 may be made of a stainless material capable of preventing corrosion and providing a sufficient strength. Since the stainless material has a relatively high emissivity of 0.16, a large amount of radiation heat may be transferred. In addition, the support 30 made of the resin has a lower emissivity than the plates, and is not entirely provided to inner surfaces of the first and second plates 10 and 20. Thus, the support 30 does not have great influence on the radiation heat. Therefore, the radiation resistance sheet 32 may be provided in a plate shape over a majority of the area of the vacuum space 50 so as to concentrate on reduction of radiation heat transferred between the first and second plates 10 and 20. A product having a low emissivity may be used as the material of the radiation resistance sheet 32. In an embodiment, an aluminum foil having an emissivity of 0.02 may be used as the radiation resistance sheet 32. Also, since the transfer of radiation heat may not be sufficiently blocked using one radiation resistance sheet, at least two radiation resistance sheets 32 may be provided at a certain distance so as not to contact each other. Also, at least one radiation resistance sheet may be provided in a state of contacting the inner surface of the first or second plate 10 or 20.

Figure 3B:
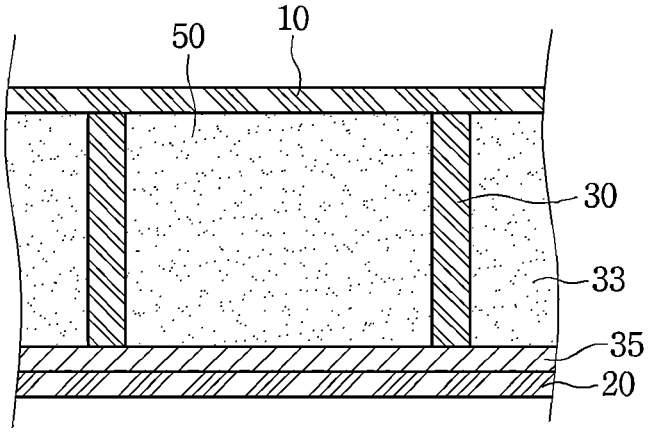

Referring back FIG. 3*b*, the distance between the plates is maintained by the support 30, and a porous material 33 may be filled in the vacuum space 50. The porous material 33 may have a higher emissivity than that of the stainless material of the first and second plates 10 and 20. However, since the porous material 33 is filled in the vacuum space 50, the porous material 33 has a high efficiency for resisting the radiation heat transfer.

In this embodiment, the vacuum adiabatic body may be fabricated without the radiation resistance sheet 32.

Figure 3C:
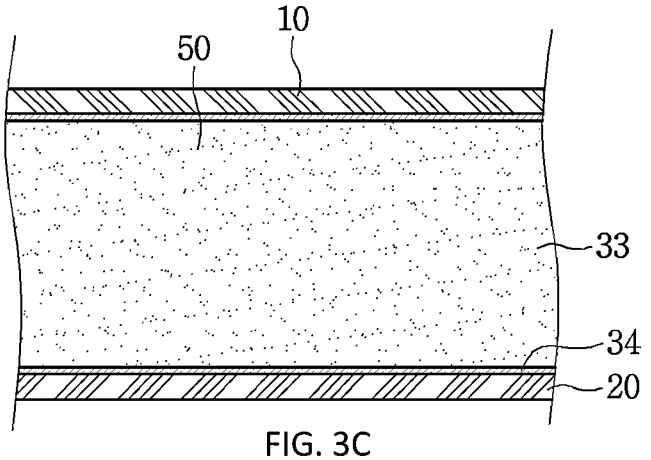

Referring to FIG. 3*c*, the support 30 for maintaining the vacuum space 50 may not be provided. A porous material 333 may be provided to be surrounded by a film 34 instead of the support 30. Here, the porous material 33 may be provided in a state of being compressed so that the gap of the vacuum space is maintained. The film 34 made of, for example, a PE material may be provided in a state in which a hole is punched in the film 34.

In this embodiment, the vacuum adiabatic body may be fabricated without the support 30. That is to say, the porous material 33 may perform the function of the radiation resistance sheet 32 and the function of the support 30 together.

FIG. 4 is a view illustrating the conductive resistance sheet and the peripheral portion thereof according to various embodiments. A structure of each of the conductive resistance sheets are briefly illustrated in FIG. 2, but will be understood in detail with reference to the drawings.

Figure 4A:
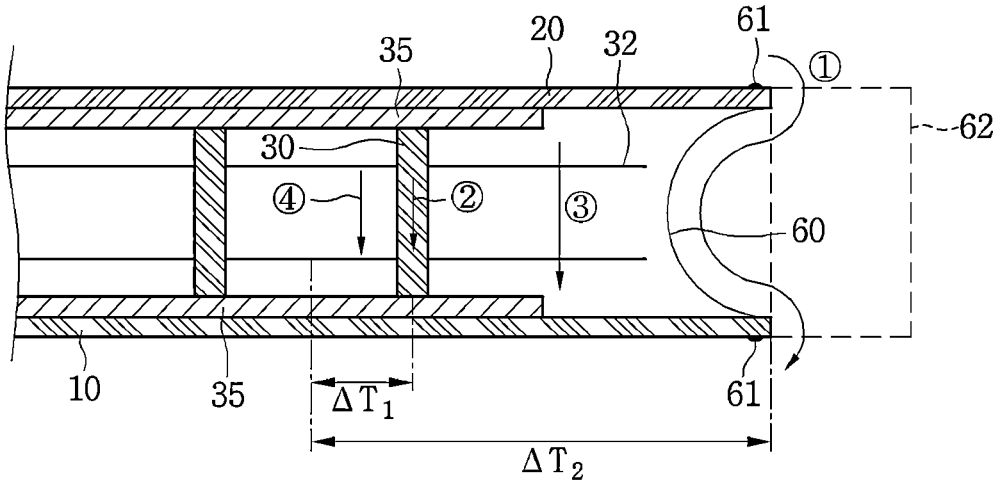
FIGS. 4A-4C are views illustrating a conductive resistance sheet and a peripheral portion thereof according to various embodiments.

First, a conductive resistance sheet proposed in FIG. 4*a* may be applied to the main body-side vacuum adiabatic body. Specifically, the first and second plates 10 and 20 are to be sealed so as to vacuum the inside of the vacuum adiabatic body. In this case, since the two plates have different temperatures from each other, heat transfer may occur between the two plates. A conductive resistance sheet 60 is provided to prevent thermal conduction between different two kinds of plates.

The conductive resistance sheet 60 may be provided with the seal 61 at which both ends of the conductive resistance sheet 60 are sealed to define at least a portion of the wall for the third space and maintain the vacuum state. The conductive resistance sheet 60 may be provided as a thin foil in unit of micrometer so as to reduce the amount of heat conducted along the wall for the third space. The seals 61 may be provided as a weld. That is, the conductive resistance sheet 60 and the plates 10 and 20 may be fused to each other. To cause a fusing operation between the conductive resistance sheet 60 and the plates 10 and 20, the conductive resistance sheet 60 and the plates 10 and 20 may be made of the same material, and a stainless material may be used as the material. The seal 61 may not be limited to the weld and may be provided through a process such as cocking. The conductive resistance sheet 60 may be provided in a curved shape. Thus, a thermal conduction distance of the conductive resistance sheet 60 is provided longer than a linear distance of each of the plates so that an amount of thermal conduction is further reduced.

A change in temperature occurs along the conductive resistance sheet 60. Therefore, to block the heat transfer to the outside of the conductive resistance sheet 60, a shield 62 may be provided at the outside of the conductive resistance sheet 60 so that an adiabatic operation occurs. In other words, in case of the refrigerator, the second plate 20 has a high temperature, and the first plate 10 has a low temperature. In addition, thermal conduction from high temperature to low temperature occurs in the conductive resistance sheet 60, and thus the temperature of the conductive resistance sheet 60 is suddenly changed. Therefore, when the conductive resistance sheet 60 is opened with respect to the outside thereof, the heat transfer through the opened place may seriously occur. To reduce the heat loss, the shield 62 is provided outside the conductive resistance sheet 60. For example, when the conductive resistance sheet 60 is exposed to any one of the low-temperature space and the high-temperature space, the conductive resistance sheet 60 does not serve as a conductive resistor as well as the exposed portion thereof, which is not preferable.

The shield 62 may be provided as a porous material contacting an outer surface of the conductive resistance sheet 60. The shield 62 may be provided as an adiabatic structure, e.g., a separate gasket, which is placed at the outside of the conductive resistance sheet 60. The shield 62 may be provided as a portion of the vacuum adiabatic body, which is provided at a position facing a corresponding conductive resistance sheet 60 when the main body-side vacuum adiabatic body is closed with respect to the door-side vacuum adiabatic body. To reduce the heat loss even when the main body and the door are opened, the shield 62 may be provided as a porous material or a separate adiabatic structure.

Figure 4B:
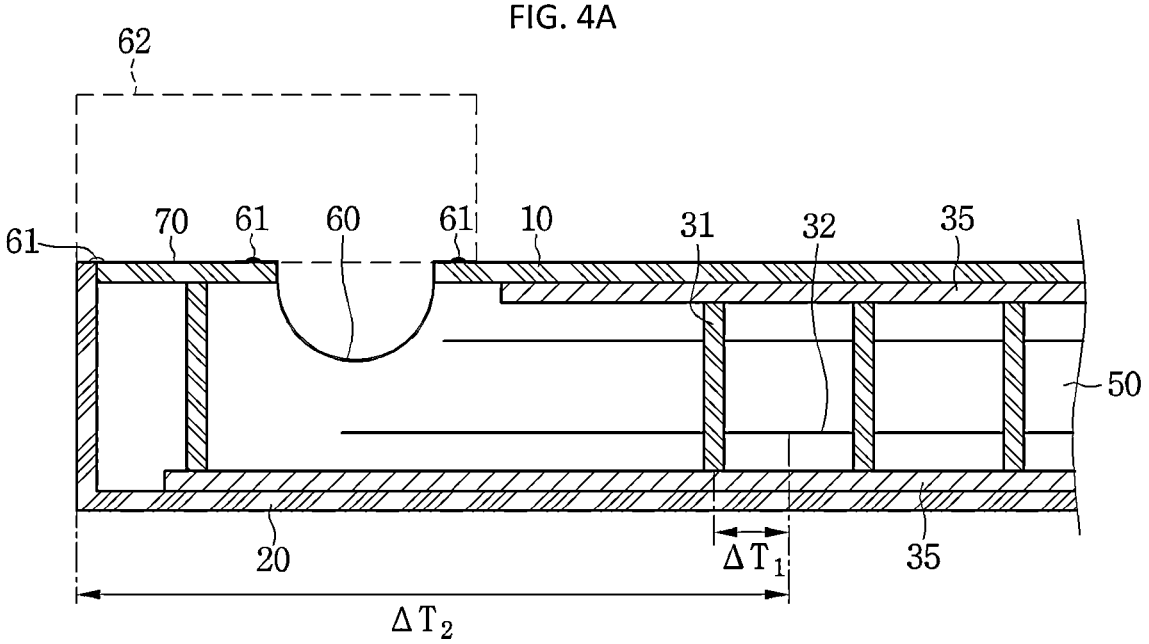

A conductive resistance sheet proposed in FIG. 4*b* may be applied to the door-side vacuum adiabatic body. In FIG. 4*b*, portions different from those of FIG. 4*a* are described in detail, and the same description is applied to portions identical to those of FIG. 4*a*. A side frame 70 is further provided outside the conductive resistance sheet 60. A component for the sealing between the door and the main body, an exhaust port necessary for an exhaust process, a getter port for vacuum maintenance, and the like may be placed on the side frame 70. This is because the mounting of components is convenient in the main body-side vacuum adiabatic body, but the mounting positions of components are limited in the door-side vacuum adiabatic body.

In the door-side vacuum adiabatic body, it is difficult to place the conductive resistance sheet 60 on a front end of the vacuum space, i.e., an edge side portion of the vacuum space. This is because, unlike the main body, a corner edge of the door is exposed to the outside. In more detail, if the conductive resistance sheet 60 is placed on the front end of the vacuum space, the corner edge of the door is exposed to the outside, and hence there is a disadvantage in that a separate adiabatic portion has to be configured so as to thermally insulate the conductive resistance sheet 60.

Figure 4C:
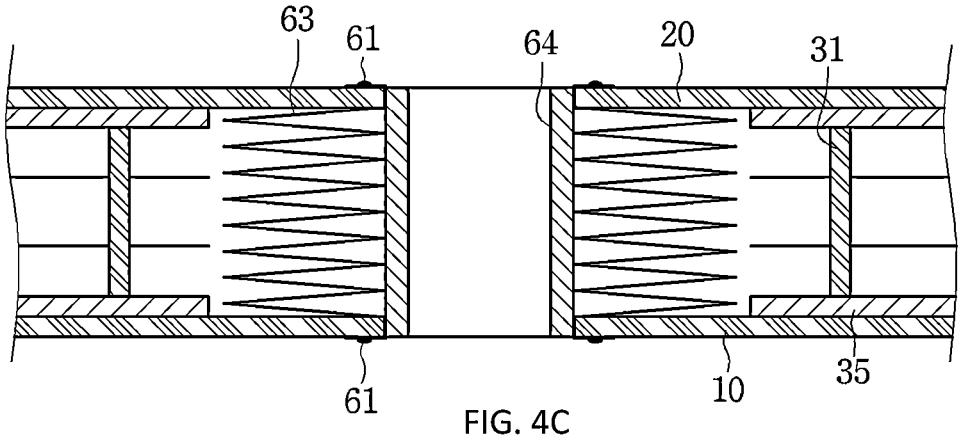

A conductive resistance sheet proposed in FIG. 4*c* may be installed in the pipeline passing through the vacuum space. In FIG. 4*c*, portions different from those of FIGS. 4*a* and 4*b* are described in detail, and the same description is applied to portions identical to those of FIGS. 4*a* and 4*b*. A conductive resistance sheet having the same shape as that of FIG. 4*a*, preferably, a wrinkled conductive resistance sheet 63 may be provided at a peripheral portion of the pipeline 64. Accordingly, a heat transfer path may be lengthened, and deformation caused by a pressure difference may be prevented. In addition, a separate shield may be provided to improve the adiabatic performance of the conductive resistance sheet.

A heat transfer path between the first and second plates 10 and 20 will be described with reference back to FIG. 4*a*. Heat passing through the vacuum adiabatic body may be divided into surface conduction heat ① conducted along a surface of the vacuum adiabatic body, more specifically, the conductive resistance sheet 60, support conduction heat ② conducted along the support 30 provided inside the vacuum adiabatic body, gas conduction heat ③ conducted through an internal gas in the vacuum space, and radiation transfer heat ④ transferred through the vacuum space.

The transfer heat may be changed depending on various depending on various design dimensions. For example, the support may be changed so that the first and second plates 10 and 20 may endure a vacuum pressure without being deformed, the vacuum pressure may be changed, the distance between the plates may be changed, and the length of the conductive resistance sheet may be changed. The transfer heat may be changed depending on a difference in temperature between the spaces (the first and second spaces) respectively provided by the plates. In the embodiment, a preferred configuration of the vacuum adiabatic body has been found by considering that its total heat transfer amount is smaller than that of a typical adiabatic structure formed by foaming polyurethane. In a typical refrigerator including the adiabatic structure formed by foaming the polyurethane, an effective heat transfer coefficient may be proposed as 19.6 mW/mK.

By performing a relative analysis on heat transfer amounts of the vacuum adiabatic body of the embodiment, a heat transfer amount by the gas conduction heat ③ may become the smallest. For example, the heat transfer amount by the gas conduction heat ③ may be controlled to be equal to or smaller than 4% of the total heat transfer amount. A heat transfer amount by solid conduction heat defined as a sum of the surface conduction heat ① and the support conduction heat ② is the largest. For example, the heat transfer amount by the solid conduction heat may reach 75% of the total heat transfer amount. A heat transfer amount by the radiation transfer heat ③ is smaller than the heat transfer amount by the solid conduction heat but larger than the heat transfer amount of the gas conduction heat. For example, the heat transfer amount by the radiation transfer heat ③ may occupy about 20% of the total heat transfer amount.

According to the heat transfer distribution, effective heat transfer coefficients (eK: effective K) (W/mK) of the surface conduction heat ①, the support conduction heat ②, the gas conduction heat ③, and the radiation transfer heat ④ may have an order of Math Equation 1 when comparing the transfer heat ①, ②, ③, and ④.

$$eK_{solid\ conduction\ heat} > eK_{radiation\ conduction\ heat} > eK_{gas\ conduction\ heat} \quad \text{[Equation 1]}$$

Here, the effective heat transfer coefficient (eK) is a value that may be measured using a shape and temperature differences of a target product. The effective heat transfer coefficient (eK) is a value that may be obtained by measuring a total heat transfer amount and a temperature at least one portion at which heat is transferred. For example, a calorific value (W) is measured using a heating source that may be quantitatively measured in the refrigerator, a temperature distribution (K) of the door is measured using heats respectively transferred through a main body and an edge of the door of the refrigerator, and a path through which heat is transferred is calculated as a conversion value (m), thereby evaluating an effective heat transfer coefficient.

The effective heat transfer coefficient (eK) of the entire vacuum adiabatic body is a value given by $k=QL/A\Delta T$. Here, Q denotes a calorific value (W) and may be obtained using a calorific value of a heater. A denotes a sectional area ($m^2$) of the vacuum adiabatic body, L denotes a thickness (m) of the vacuum adiabatic body, and $\Delta T$ denotes a temperature difference.

For the surface conduction heat, a conductive calorific value may be obtained through a temperature difference $\Delta T$ between an entrance and an exit of the conductive resistance sheet 60 or 63, a sectional area A of the conductive resistance sheet, a length L of the conductive resistance sheet, and a thermal conductivity (k) of the conductive resistance sheet (the thermal conductivity of the conductive resistance sheet is a material property of a material and may be obtained in advance). For the support conduction heat, a conductive calorific value may be obtained through a temperature difference $\Delta T$ between an entrance and an exit of the support 30, a sectional area A of the support, a length L of the support, and a thermal conductivity (k) of the support. Here, the thermal conductivity of the support may be a material property of a material and may be obtained in advance. The sum of the gas conduction heat ③, and the radiation transfer heat ④ may be obtained by subtracting the surface conduction heat and the support conduction heat from the heat transfer amount of the entire vacuum adiabatic body. A ratio of the gas conduction heat ③, and the radiation transfer heat ④ may be obtained by evaluating radiation transfer heat when no gas conduction heat exists by remarkably lowering a vacuum degree of the vacuum space 50.

When a porous material is provided inside the vacuum space 50, porous material conduction heat ⑤ may be a sum of the support conduction heat ② and the radiation transfer heat ④. The porous material conduction heat may be changed depending on various variables including a kind, an amount, and the like of the porous material.

According to an embodiment, a temperature difference $\Delta T_1$ between a geometric center formed by adjacent bars 31 and a point at which each of the bars 31 is located may be provided to be less than 0.5° C. Also, a temperature difference $\Delta T_2$ between the geometric center formed by the adjacent bars 31 and an edge of the vacuum adiabatic body may be provided to be less than 0.5° C. In the second plate 20, a temperature difference between an average temperature of the second plate and a temperature at a point at which a heat transfer path passing through the conductive resistance sheet 60 or 63 meets the second plate may be the largest. For example, when the second space is a region hotter than the first space, the temperature at the point at which the heat transfer path passing through the conductive resistance sheet meets the second plate becomes lowest. Similarly, when the second space is a region colder than the first space, the temperature at the point at which the heat transfer path passing through the conductive resistance sheet meets the second plate becomes highest.

This means that the amount of heat transferred through other points except the surface conduction heat passing through the conductive resistance sheet should be controlled, and the entire heat transfer amount satisfying the vacuum adiabatic body may be achieved only when the surface conduction heat occupies the largest heat transfer amount. For this, a temperature variation of the conductive resistance sheet may be controlled to be larger than that of the plate.

Physical characteristics of the components constituting the vacuum adiabatic body will be described. In the vacuum adiabatic body, force due to a vacuum pressure is applied to all of the components. Therefore, a material having a strength (N/m2) of a certain level may be used.

Under such circumferences, the plates 10 and 20 and the side frame 70 may be made of a material having sufficient strength with which the plates 10 and 20 are not damaged by even the vacuum pressure. For example, when the number of bars 31 decreases to limit the support conduction heat, the deformation of each of the plates occurs due to the vacuum pressure, which may bad influence on an outer appearance of the refrigerator. The radiation resistance sheet 32 may be made of a material that has a low emissivity and may be easily subjected to thin film processing. Also, the radiation resistance sheet 32 has to ensure strength enough without being deformed by an external impact. The support 30 is provided to strength that is enough to support the force by the vacuum pressure and endure the external impact, and is to have processability. The conductive resistance sheet 60 may be made of a material that has a thin plate shape and may endure the vacuum pressure.

In an embodiment, the plate, the side frame, and the conductive resistance sheet may be made of stainless materials having the same strength. The radiation resistance sheet may be made of aluminum having weaker strength than that of each of the stainless materials. The support may be made of a resin having weaker strength than that of the aluminum.

Unlike the strength from the point of view of the materials, an analysis from the point of view of stiffness is required. The stiffness (N/m) may be a property that is not be easily deformed. Thus, although the same material is used, its stiffness may vary depending on its shape. The conductive resistance sheets 60 or 63 may be made of a material having strength, but the stiffness of the material may be low so as to increase in heat resistance and minimize the radiation heat as the conductive resistance sheet is uniformly spread without any roughness when the vacuum pressure is applied. The radiation resistance sheet 32 requires stiffness having a certain level so as not to contact another component due to deformation. Particularly, an edge of the radiation resistance sheet may generate the conduction heat due to drooping caused by the self-load of the radiation resistance sheet. Therefore, the stiffness having the certain level is required. The support 30 requires a stiffness enough to endure compressive stress from the plate and the external impact.

In an embodiment, the plate and the side frame may have the highest stiffness so as to prevent the deformation caused by the vacuum pressure. The support, particularly, the bar may have the second highest stiffness. The radiation resistance sheet may have stiffness that is lower than that of the support but higher than that of the conductive resistance sheet. Lastly, the conductive resistance sheet may be made of a material that is easily deformed by the vacuum pressure and has the lowest stiffness.

Even when the porous material 33 is filled in the vacuum space 50, the conductive resistance sheet may have the lowest stiffness, and each of the plate and the side frame may have the highest stiffness.

Hereinafter, the vacuum pressure may be determined depending on internal states of the vacuum adiabatic body. As already described above, a vacuum pressure is to be maintained inside the vacuum adiabatic body so as to reduce heat transfer. Here, it will be easily expected that the vacuum pressure is maintained as low as possible so as to reduce the heat transfer.

The vacuum space may resist to heat transfer by only the support 30. Here, a porous material 33 may be filled with the support inside the vacuum space 50 to resist to the heat transfer. The heat transfer to the porous material may resist without applying the support.

The case in which only the support is applied will be described.

Figure 5:
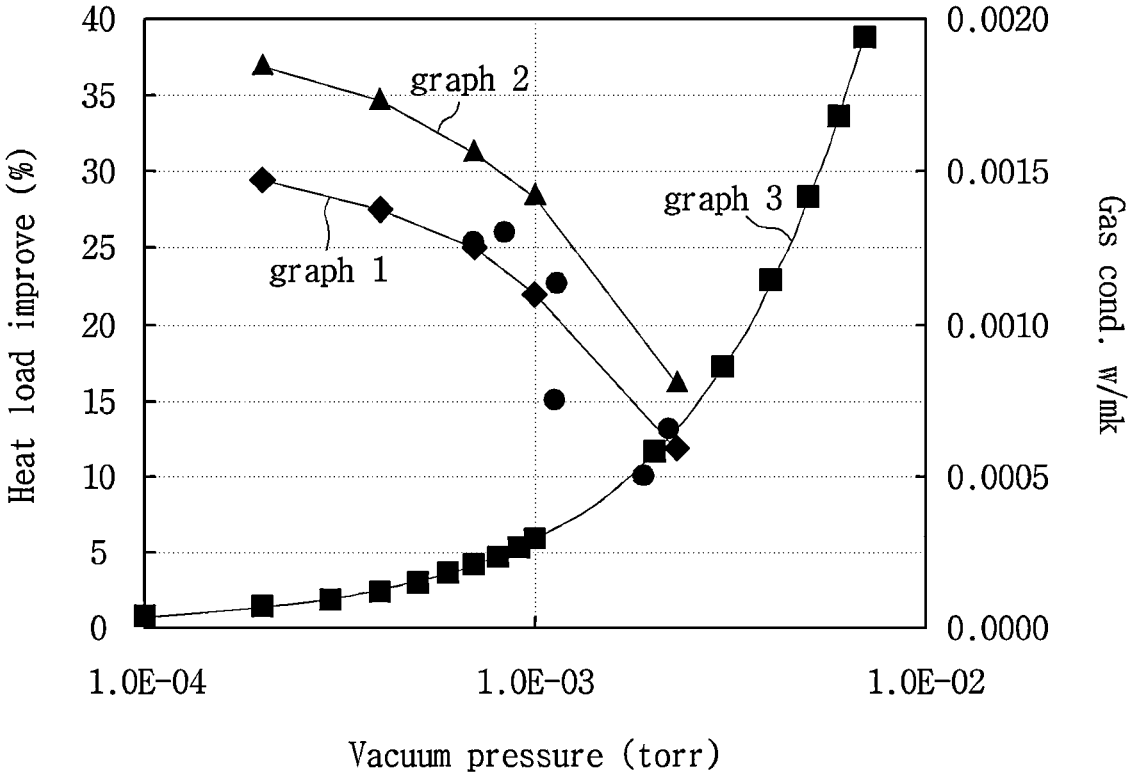
FIG. 5 is a graph illustrating a variation in adiabatic performance and a variation in gas conductivity according to a vacuum pressure by applying a simulation.

FIG. 5 is a graph illustrating a variation in adiabatic performance and a variation in gas conductivity according to the vacuum pressure by applying a simulation.

Referring to FIG. 5, it may be seen that, as the vacuum pressure decreases, i.e., as the vacuum degree increases, a heat load in the case of only the main body (Graph 1) or in the case in which the main body and the door are combined together (Graph 2) decreases as compared to that in the case of the typical product formed by foaming polyurethane, thereby improving the adiabatic performance. However, it may be seen that the degree of improvement of the adiabatic performance is gradually lowered. Also, it may be seen that, as the vacuum pressure decreases, the gas conductivity (Graph 3) decreases. However, it may be seen that, although the vacuum pressure decreases, a ratio at which the adiabatic performance and the gas conductivity are improved is gradually lowered. Therefore, it is preferable that the vacuum pressure decreases as low as possible. However, it takes long time to obtain an excessive vacuum pressure, and much cost is consumed due to an excessive use of the getter. In the embodiment, an optimal vacuum pressure is proposed from the above-described point of view.

Figure 6:
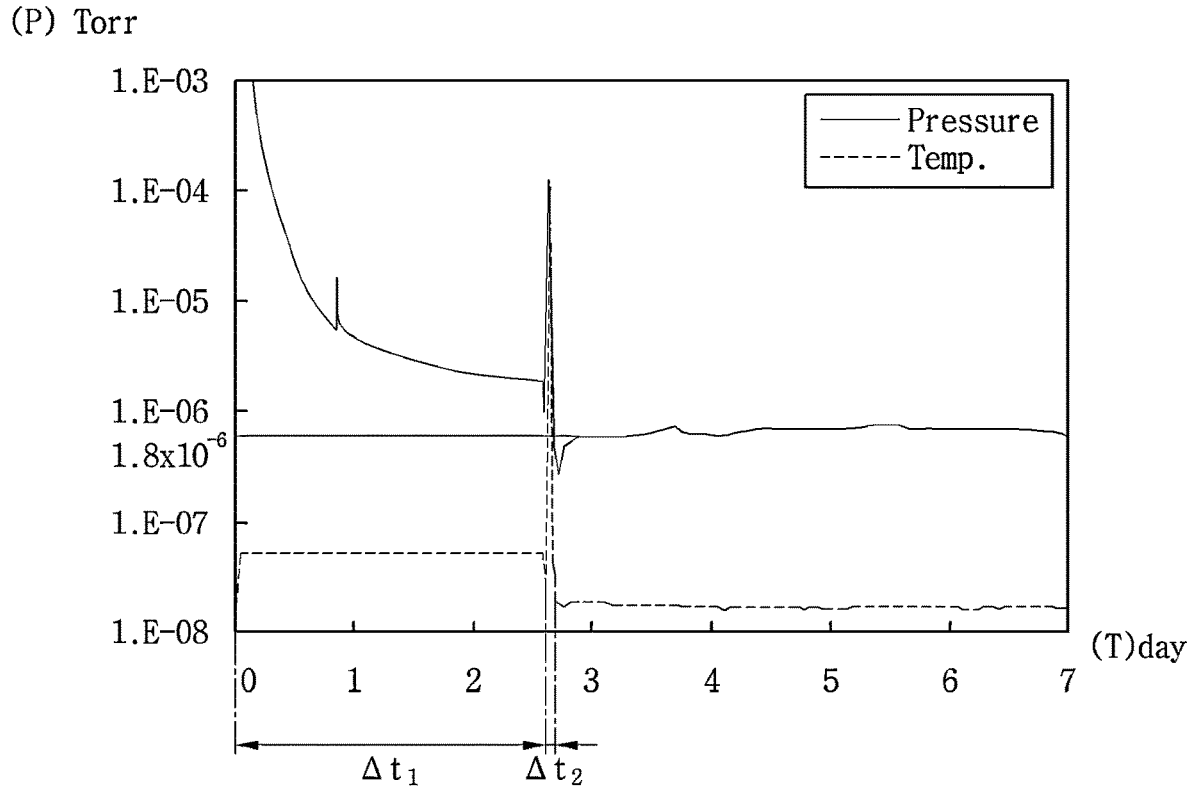
FIG. 6 is a graph illustrating results obtained by observing a time and a pressure in a process of exhausting the inside of the vacuum adiabatic body when a support is used.

FIG. 6 is a graph illustrating results obtained by observing a time and a pressure in a process of exhausting the inside of the vacuum adiabatic body when the support is used.

Referring to FIG. 6, to create the vacuum space 50 to be in the vacuum state, a gas in the vacuum space 50 is exhausted by a vacuum pump while evaporating a latent gas remaining in the components of the vacuum space 50 through baking. However, if the vacuum pressure reaches a certain level or more, there exists a point at which the level of the vacuum pressure does not increase any more ($\Delta t_1$). Thereafter, the getter is activated by disconnecting the vacuum space 50 from the vacuum pump and applying heat to the vacuum space 50 ($\Delta t_2$). If the getter is activated, the pressure in the vacuum space 50 decreases for a certain period of time, but then normalized to maintain a vacuum pressure having a certain level. The vacuum pressure that maintains the certain level after the activation of the getter is approximately $1.8\times10^{-6}$ Torr.

In the embodiment, a point at which the vacuum pressure is not substantially decreased any more even though the gas is exhausted by operating the vacuum pump is set to the lowest limit of the vacuum pressure used in the vacuum adiabatic body, thereby setting the minimum internal pressure of the vacuum space 50 to $1.8\times10^{-6}$ Torr.

Figure 7:
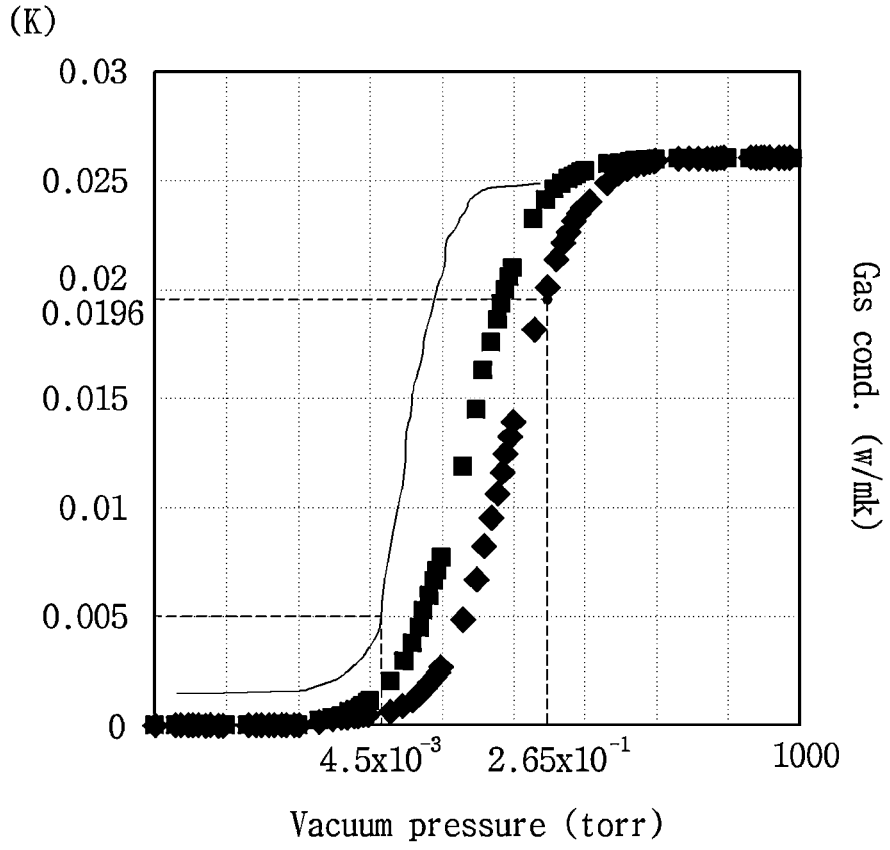
FIG. 7 is a graph illustrating results obtained by comparing a vacuum pressure with gas conductivity.

FIG. 7 is a graph illustrating results obtained by comparing the vacuum pressure with gas conductivity.

Referring to FIG. 7, gas conductivity with respect to the vacuum pressure depending on a size of the gap in the vacuum space 50 was represented as a graph of effective heat transfer coefficient (eK). The effective heat transfer coefficient (eK) was measured when the gap in the vacuum space 50 has three sizes of 2.76 mm, 6.5 mm, and 12.5 mm. The gap in the vacuum space 50 is defined as follows. When the radiation resistance sheet 32 exists inside vacuum space 50, the gap is a distance between the radiation resistance sheet 32 and the plate adjacent thereto. When the radiation resistance sheet 32 does not exist inside vacuum space 50, the gap is a distance between the first and second plates.

It was seen that, since the size of the gap is small at a point corresponding to a typical effective heat transfer coefficient of 0.0196 W/mK, which is provided to an adiabatic material formed by foaming polyurethane, the vacuum pressure is $2.65\times10^{-1}$ Torr even when the size of the gap is 2.76 mm. Meanwhile, it was seen that the point at which reduction in adiabatic effect caused by the gas conduction heat is saturated even though the vacuum pressure decreases is a point at which the vacuum pressure is approximately $4.5\times10^{-3}$ Torr. The vacuum pressure of $4.5\times10^{-3}$ Torr may be defined as the point at which the reduction in adiabatic effect caused by the gas conduction heat is saturated. Also, when the effective heat transfer coefficient is 0.1 W/mK, the vacuum pressure is $1.2\times10^{-2}$ Torr.

When the vacuum space 50 is not provided with the support but provided with the porous material, the size of the gap ranges from a few micrometers to a few hundreds of micrometers. In this case, the amount of radiation heat transfer is small due to the porous material even when the vacuum pressure is relatively high, i.e., when the vacuum degree is low. Therefore, an appropriate vacuum pump is used to adjust the vacuum pressure. The vacuum pressure appropriate to the corresponding vacuum pump is approximately $2.010^{-4}$ Torr. Also, the vacuum pressure at the point at which the reduction in adiabatic effect caused by the gas conduction heat is saturated is approximately $4.7\times10^{-2}$ Torr. Also, the pressure where the reduction in adiabatic effect caused by gas conduction heat reaches the typical effective heat transfer coefficient of 0.0196 W/mK is 730 Torr.

When the support and the porous material are provided together in the vacuum space, a vacuum pressure may be created and used, which is middle between the vacuum pressure when only the support is used and the vacuum pressure when only the porous material is used. When only the porous material is used, the lowest vacuum pressure may be used.

The vacuum adiabatic body includes a first plate defining at least a portion of a wall for the first space and a second plate defining at least a portion of a wall for the second space and having a temperature different from the first space. The first plate may include a plurality of layers. The second plate may include a plurality of layers.

The vacuum adiabatic body may further include a seal configured to seal the first plate and the second plate so as to provide a third space that is in a vacuum state and has a temperature between a temperature of the first space and a temperature of the second space.

When one of the first plate and the second plate is disposed in an inner space of the third space, the plate may be represented as an inner plate. When the other one of the first plate and the second plate is disposed in an outer space of the third space, the plate may be represented as an outer plate. For example, the inner space of the third space may be a storage room of the refrigerator. The outer space of the third space may be an outer space of the refrigerator.

The vacuum adiabatic body may further include a support that maintains the third space.

The vacuum adiabatic body may further include a conductive resistance sheet connecting the first plate to the second plate to reduce an amount of heat transferred between the first plate and the second plate.

At least a portion of the conductive resistance sheet may be disposed to face the third space. The conductive resistance sheet may be disposed between an edge of the first plate and an edge of the second plate. The conductive resistance sheet may be disposed between a surface on which the first plate faces the first space and a surface on which the second plate faces the second space. The conductive resistance sheet may be disposed between a side surface of the first plate and a side surface of the second plate.

At least a portion of the conductive resistance sheet may extend in a direction that is substantially the same as the direction in which the first plate extends.

A thickness of the conductive resistance sheet may be thinner than at least one of the first plate or the second plate. The more the conductive resistance sheet decreases in thickness, the more heat transfer may decrease between the first plate and the second plate.

The more the conductive resistance sheet decreases in thickness, the more it may be difficult to couple the conductive resistance sheet between the first plate and the second plate.

One end of the conductive resistance sheet may be disposed to overlap at least a portion of the first plate. This is to provide a space for coupling one end of the conductive resistance sheet to the first plate. Here, the coupling method may include welding.

The other end of the conductive resistance sheet may be arranged to overlap at least a portion of the second plate. This is to provide a space for coupling the other end of the conductive resistance sheet to the second plate. Here, the coupling method may include welding.

As another embodiment of replacing the conductive resistance sheet, the conductive resistance sheet may be deleted, and one of the first plate and the second plate may be thinner than the other. In this case, any thickness may be greater than that of the conductive resistance sheet. In this case, any length may be greater than that of the conductive resistance sheet. With this configuration, it is possible to reduce the increase in heat transfer by deleting the conductive resistance sheet. Also, this configuration may reduce difficulty in coupling the first plate to the second plate.

At least a portion of the first plate and at least a portion of the second plate may be disposed to overlap each other. This is to provide a space for coupling the first plate to the second plate. An additional cover may be disposed on any one of the first plate and the second plate, which has a thin thickness. This is to protect the thin plate.

The vacuum adiabatic body may further include an exhaust port for discharging a gas in the vacuum space.

Hereinafter, a configuration for discharging defrosting water will be briefly described.

Figure 8:
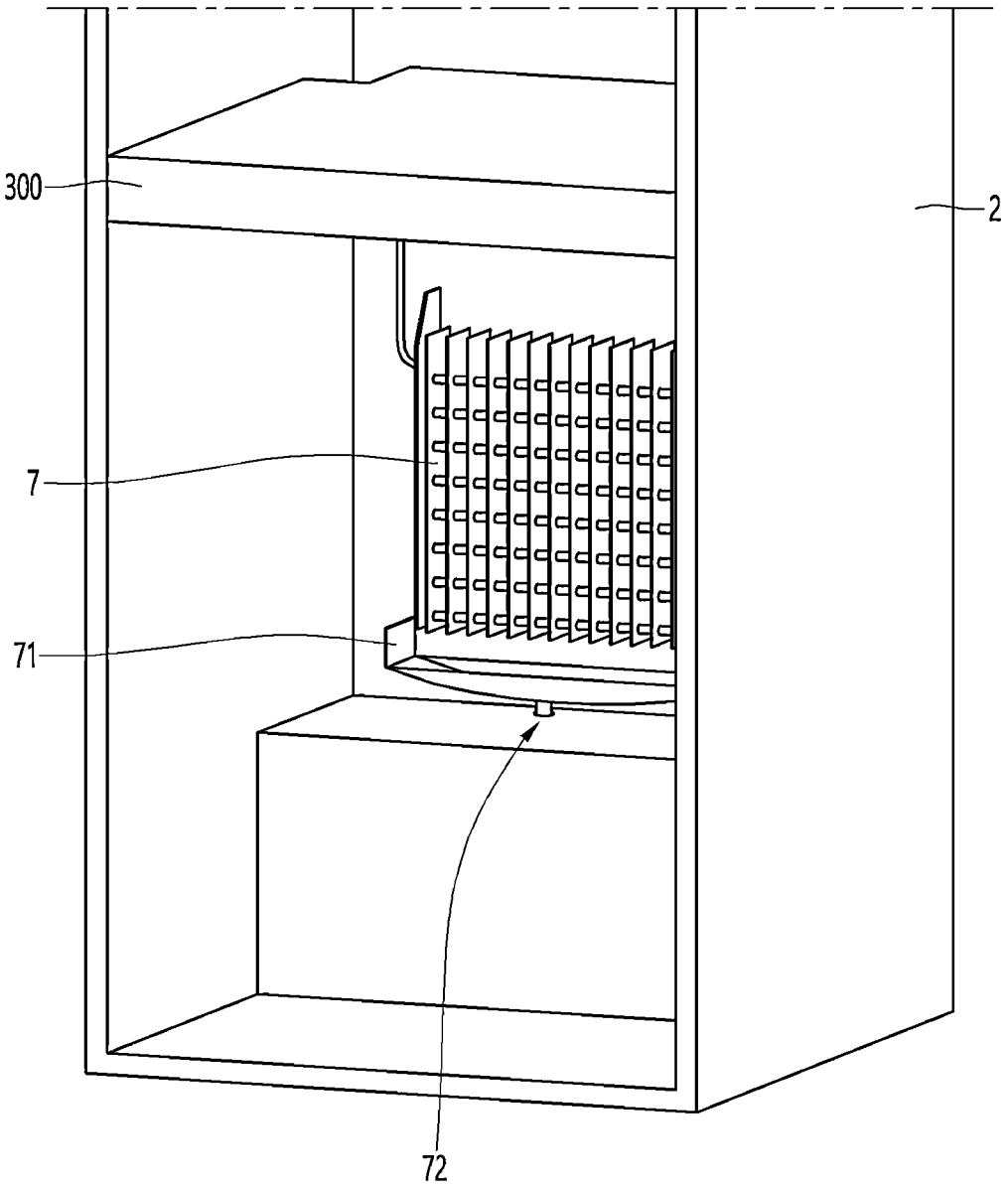
FIG. 8 is a perspective view of observing the inside of the refrigerator.

FIG. 8 is a perspective view of observing the inside of the refrigerator.

Referring to FIG. 8, an evaporator 7 is placed inside the main body 2, and a refrigerant flowing through the inside of the evaporator 7 is evaporated to supply cool air to the inside. The cool air generated in the evaporator 7 may be supplied to the freezing compartment and may be supplied to the refrigerating compartment partitioned from the freezing compartment by a mullion 300. The mullion may be referred to as a partition wall.

As an operation of the evaporator 7 is accumulated, frost is accumulated on an outer surface of the evaporator 7, and when a certain amount of frost is accumulated, a defrosting operation is performed to remove the frost.

The defrosting operation may be performed by applying heat to the frost, and the defrosting water removed by the heat may be collected in a drain pan 71 and then discharged to the outside.

A drain 72 is provided on a wall of the main body 2 connecting the drain pan 71 to the outside. The main body 2 may be provided as a vacuum adiabatic body, and the drain 72 may be provided by opening the vacuum adiabatic body. A drain pipe 85 guiding the defrosting water may pass through the drain 72.

Since the adiabatic wall of the vacuum adiabatic body is in a high vacuum state, it may be provided with a significantly thinner thickness than the foamed adiabatic wall provided by typical urethane foam. Likewise, the drain 72 is also provided to a thin thickness. Nevertheless, it is necessary to reduce a loss of cool air that may be caused by heat conduction and tropical flow and to prevent pipeline blockage due to freezing of the defrosting water. In addition, it is preferable to reduce an occurrence of dew generated by the temperature change in the peripheral portion, thereby improving reliability of the device.

Hereinafter, a configuration and operation of a structure providing the drain capable of achieving the above object will be described.

Figure 9:
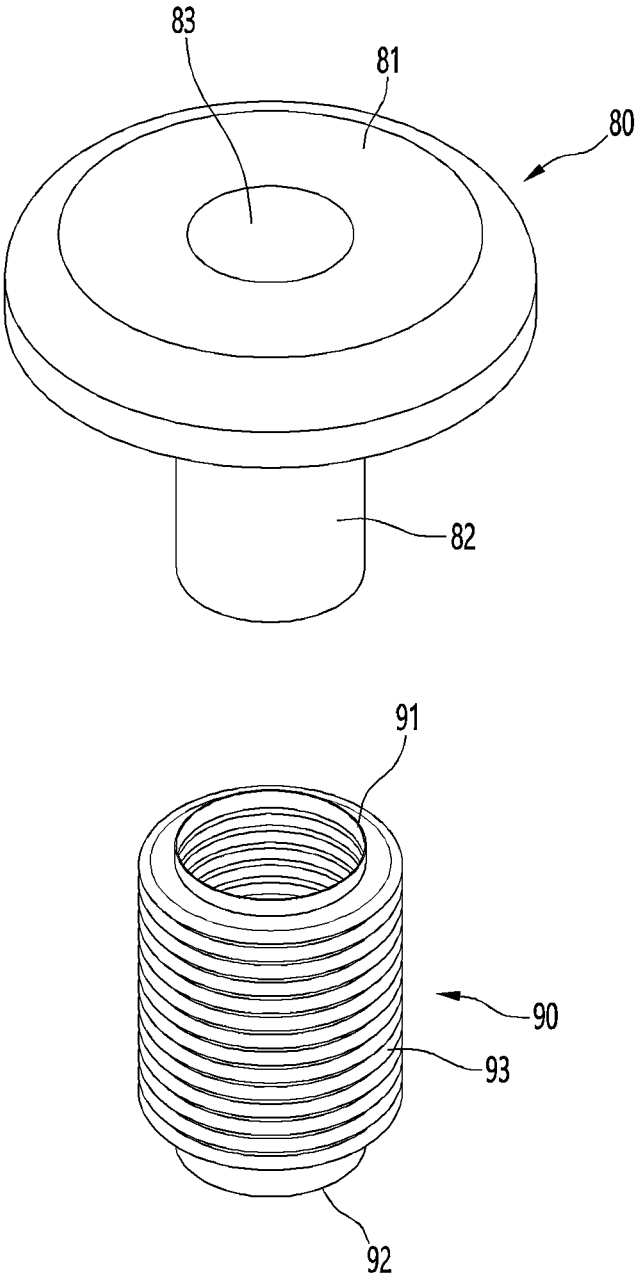
FIG. 9 is a perspective view of a drain according to an embodiment.

FIG. 9 is a perspective view of a component that provides the drain according to an embodiment.

Referring to FIG. 9, the drain 72 discharging the defrosting water includes a wrinkle pipe 90 connecting the openings of the first and second plates 10 and 20 to each other to seal the third space and a wrinkle pipe adiabatic material 80 contacting the inside of the wrinkle pipe 90 and the first plate 10 inside the refrigerator. The wrinkle pipe adiabatic material 80 may be provided as a single article and be fitted into the wrinkle pipe in a manner such as press-fitting. Therefore, it may be easily manufactured and installed. The wrinkle pipe adiabatic material may be referred to as an adiabatic material for brevity.

The wrinkle pipe 90 may be understood as a kind of the wrinkle-type conductive resistance sheet 63, but has the advantage of being capable of mass production due to the convenience of molding. The wrinkle pipe 90 may also be called a thin film tube, which is a tube having a thin thickness by naming the wrinkle-type conductive resistance sheet 63 together. The thin pipe may be provided to a thin thickness to resist to thermal conductivity. The thin pipe may resist to the heat conduction by using a narrow heat conduction area. The thin pipe may be provided in a state in which wrinkles are removed if it resists to only conduction, but it is preferable that wrinkles are provided to lengthen a heat conduction path. The configuration of the wrinkle pipe and the wrinkle-type conductive sheet may be clearly understood in the description of each of the portions.

The wrinkle pipe 90 may be provided in a substantially cylindrical shape. The wrinkle pipe 90 includes a cylindrical body 93 (or a main body) in which many wrinkles are provided in an annular shape, one coupling portion 91 coupled to the first plate 10, and the other coupling portion 92 coupled to the second plate 20. The coupling portions 91 and 92 serve to seal the third space and may be coupled to each relative portion by welding or the like.

The wrinkle pipe adiabatic material 80 includes a head 81 contacting an inner surface of the first plate 10 that provides at least one wall of the first space inside the refrigerator, and an extension 82 extending from the head 81 to the second plate 20, and a hole 83 passing through the inside of each of the head 81 and the extension 82.

Although the defrosting water is provided in the hole 83 as an example, a material that is not limited to the defrosting water may be discharged from the inside of the refrigerator to the outside of the refrigerator. A drain pipe 85 guiding the defrosting water to the outside may be inserted into the hole 83. When other materials or articles are discharged through the drain pipe, the drain pipe may be referred to as a through pipeline, and a case in which a structure such as an electric wire passes through the hole 83 may be sufficiently considered. However, the case in which the drain pipe passes through the hole 83 may be most preferably illustrated.

Figure 10:
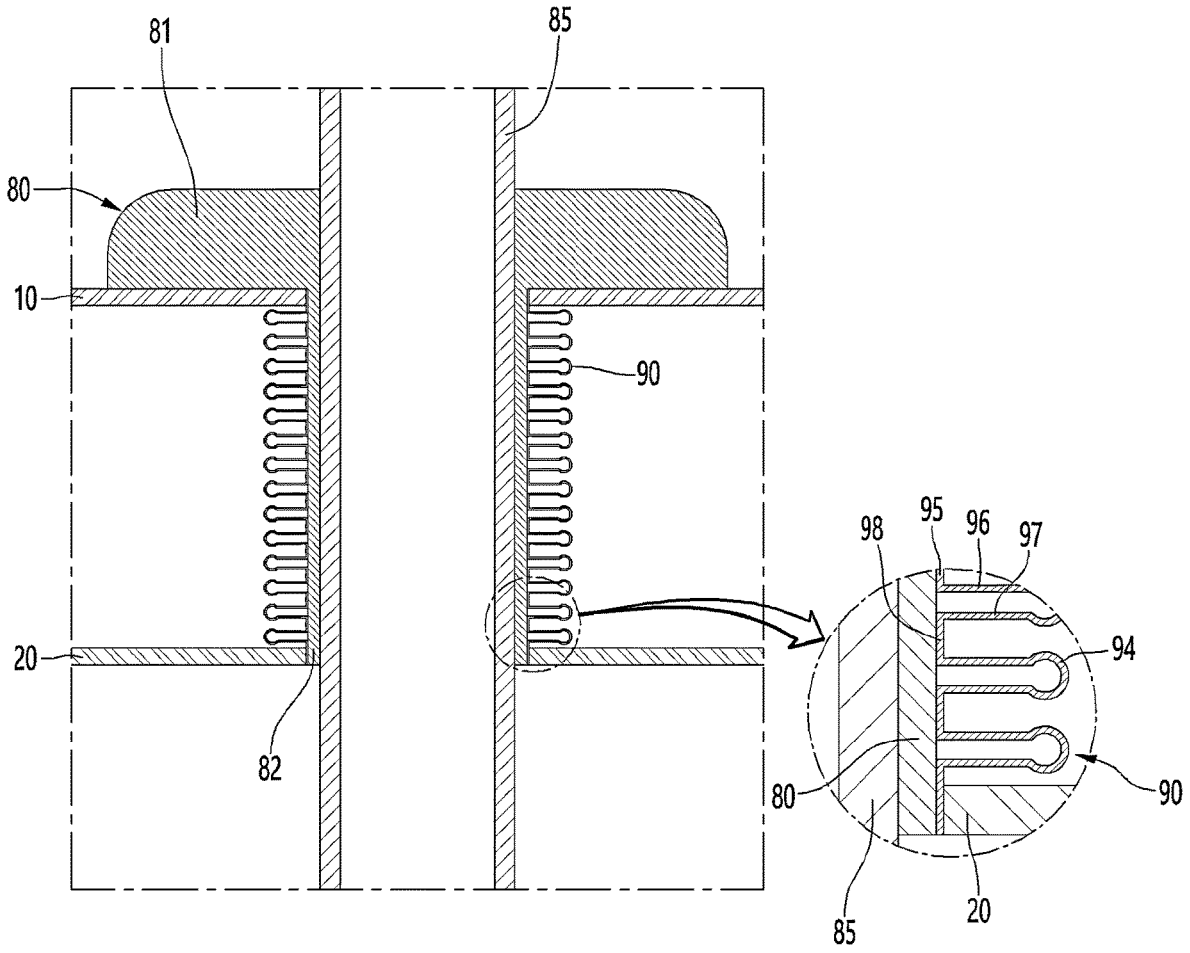
FIG. 10 is a cross-sectional view of the drain.

FIG. 10 is a cross-sectional view of the drain.

Referring to FIG. 10, the wrinkle pipe 90 connects the opened portions of the first plate 10 and the second plate 20 to each other to seal the vacuum space. The wrinkle pipe adiabatic material 80 is inserted into the wrinkle pipe 90.

The extension 82 of the wrinkle pipe adiabatic material 80 may be interposed between the inner surface of the wrinkle pipe 90 and the drain pipe 85 to block heat exchange between the wrinkle pipe 90 and the drain pipe 85.

The head 81 of the wrinkle pipe adiabatic material 80 may extend from an upper end of the extension 82. The head 81 may extend concentrically along the inner surface of the first plate 10. The head 81 may be provided as a portion having a predetermined diameter and a predetermined thickness.

The head 81 may prevent the first plate 10 from being exposed to the first space. Thus, the heat transfer by natural convection and forced convection from the cool air within the refrigerator to the first plate 10 may be blocked. In other words, the first plate 10 overlapping the head 81 may have a temperature higher than that of a gas within the refrigerator. Of course, this case may be limited in the case of the refrigerator.

Here, it is necessary to note that the head 81 is provided only to the first plate 10 and is not provided to the second plate 20. Thus, the second plate 20 may perform the natural convection and the forced convection on the whole portion with respect to a gas outside the refrigerator. In other words, in view of the opening of each plate, the second plate 20 has the convective heat exchange with the all portions connected to the openings. On the other hand, the first plate 10 may be heat-exchanged with air within the refrigerator from a portion that is spaced a predetermined distance from the opening, i.e., a point that gets out of the head 81.

As a result, a distance for the conduction heat transfer from the inside to the outside of the refrigerator increases so much. In other words, when observed from a center of the first plate 10, a temperature is lowest at a point aligned with an outer edge of the head 81, and then, the temperature may increase as it enters. That is, a portion of the first plate 10 may function as a conductive resistance portion that resists to the thermal conduction.

Of course, a place on which the function of the largest conductive resistance in the drain 72 may be the wrinkle pipe 90. Nevertheless, the lack of a cool air loss to the wrinkle pipe 90 may be supplemented by a method of blocking the convection between the air inside the refrigerator and the plate by using the head 81.

On the other hand, the second plate 20 has the convective heat exchange with the air outside the refrigerator at all portions connected to the openings. Thus, the heat outside the refrigerator may be introduced along the wrinkle pipe 90 by a predetermined distance.

In this case, freezing of the defrosting water inside the drain pipe 85 may be prevented to prevent the drain pipe 85 from being blocked. In addition, according to changes in an operation mode such as a normal operation and a defrosting operation, dew that may be generated on the periphery of the drain pipe 85, the wrinkle pipe 90, and the plates 10 and 20 may be evaporated through a predetermined heat. Thus, it is possible to prevent the product from being damaged due to freezing of the dew and to prevent the product from being degraded due to moisture.

A main body 93 of the wrinkle pipe 90 is provided with a plurality of wrinkles. The wrinkles are intended to prevent the cool air loss by increasing in heat conduction length between the plates 10 and 20. Like the wrinkle-type conductive resistance sheet 63, the thickness may be reduced to reduce the conduction heat transfer amount, and also, the conduction heat transfer amount may be further reduced by using the pleats.

A wrinkle unit of the wrinkle pipe 90 may include two vertical portions 95 and 98, two horizontal portions 96 and 97, and an extension distance portion 94 provided therebetween. The extension distance portion 94 has a shape connecting the horizontal portions 96 and 97 to each other in a round manner and may be provided larger than a width of each of the horizontal portions 96 and 97.

According to the above shape, when only the vertical portions 95 and 98 are provided, the extension distance portion 94 may increase in path of the cool air and heat, which flow along the wrinkle pipe when compared to the case in which only the vertical portions 95 and 98 and the horizontal portions 96 and 97 are provided. In other words, it is possible to obtain an effect of further reducing the heat transfer amount by the conduction heat transfer.

Here, the meanings of the vertical and horizontal (the horizontal plane and the vertical plane are the same) refer to two extension directions crossing each other, and not only orthogonal directionality.

The wrinkle pipe adiabatic material 80 may be processed by a foaming material, an elastically deformable material, a soft material, a sealing material, an intervening or mixed material, or adding of the seal. Thus, a contact surface between the wrinkle pipe 90 and the extension 82, a contact surface between the drain pipe 854 and the extension 82, and a contact surface between the head 81 and the first plate 10 may be completely sealed. Thus, convection cooling by the natural convection and the forced convection through the contact surfaces between the portions may be blocked.

Figure 11A:
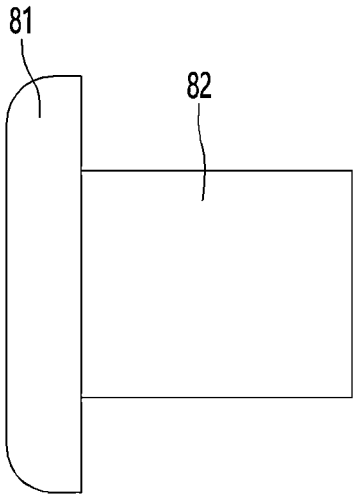
Figure 11B:
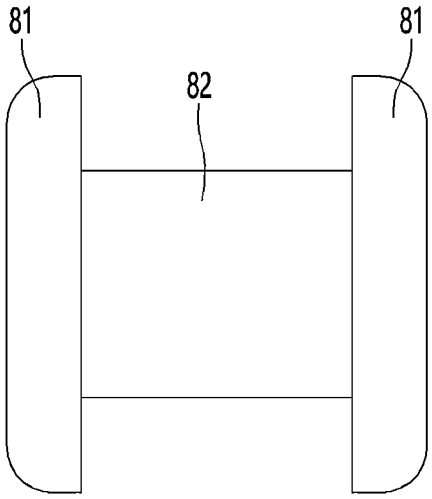
Figure 12:
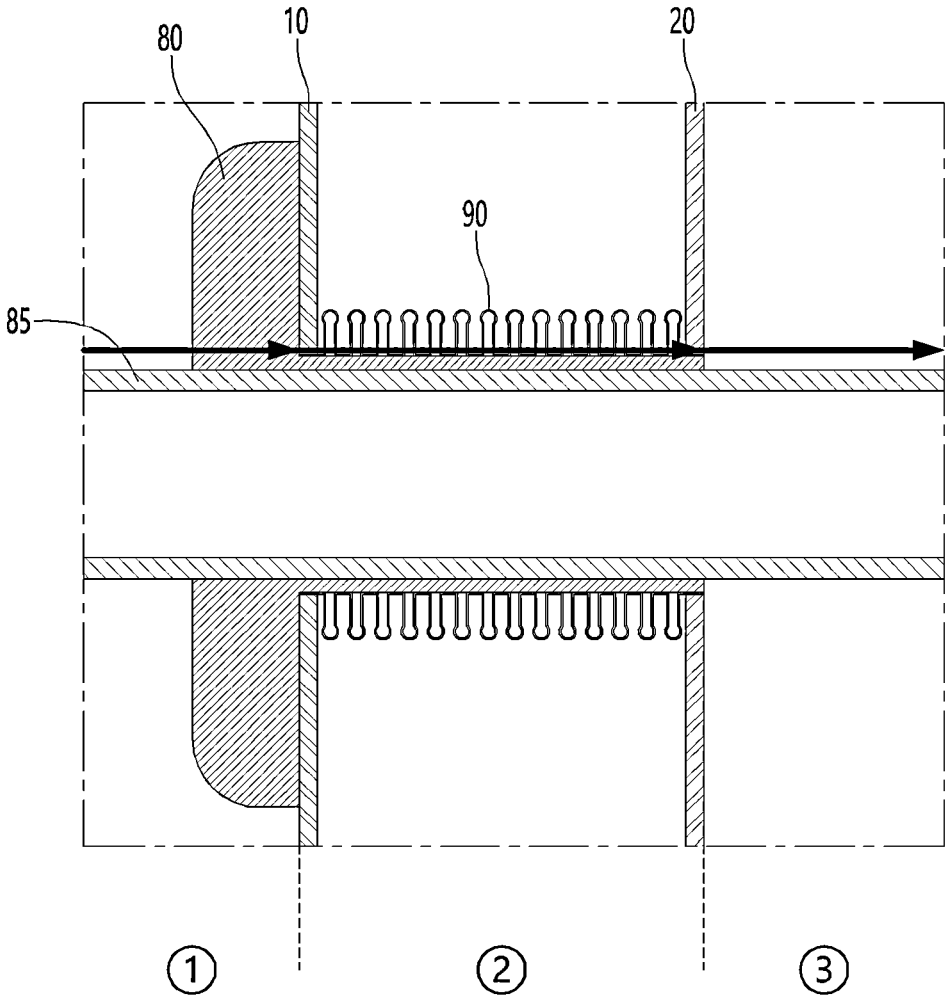
Figure 13:
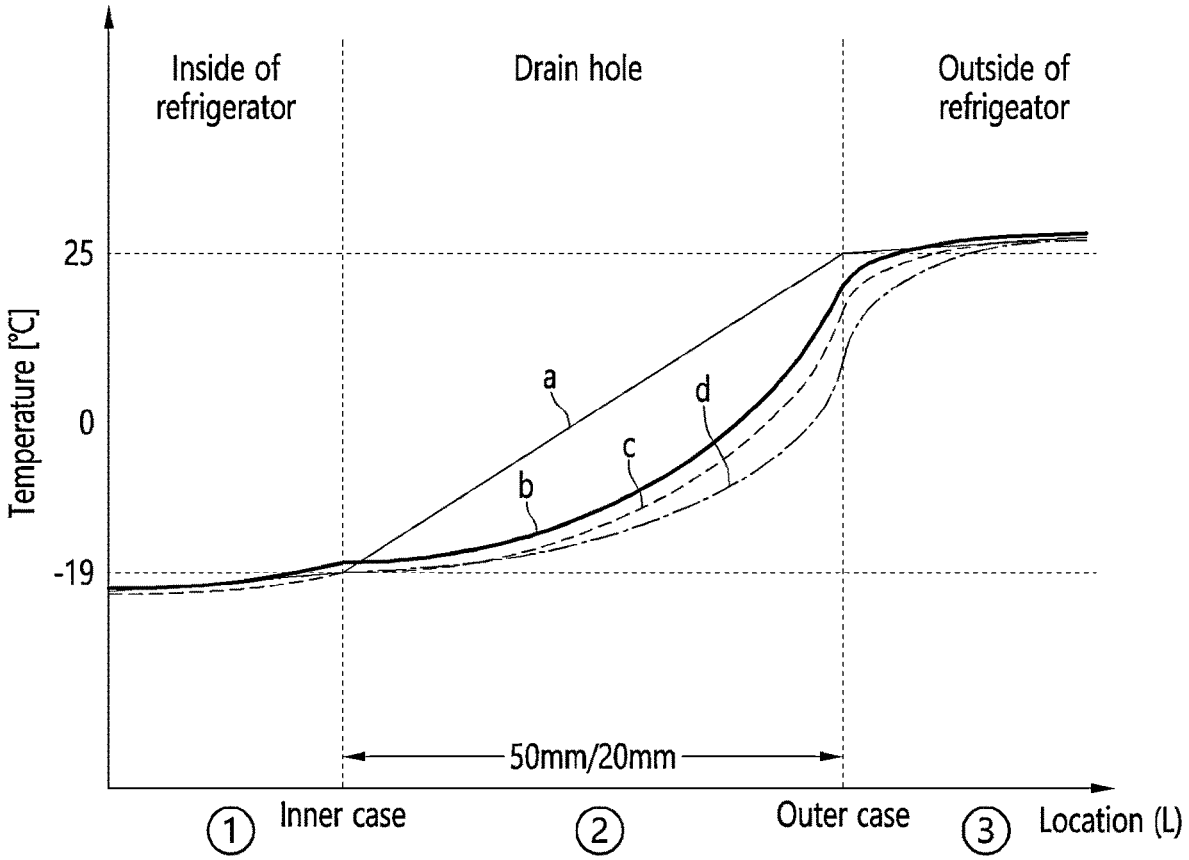

FIGS. 11 to 13 are views for explaining an effect of the wrinkle pipe adiabatic material according to an embodiment, wherein FIG. 11 is a view comparing a case in which the head is provided on one end of the wrinkle pipe adiabatic material to a case in which the head is provided on all of both ends of the wrinkle pipe adiabatic material according to an embodiment, FIG. 12 is a view illustrating the conduction heat flow between the plates, and FIG. 13 is a view comparing a temperature change for points of the drain according to an adiabatic manner.

Referring to FIG. 11, unlike the case (a) according to the embodiment, a case (b) in which the head 81 is provided on each of both ends of the wrinkle pipe adiabatic material is illustrated.

Referring to FIG. 12, three paths through which the cool air flows are illustrated. In detail, it was divided into three paths ( ), i.e., a path ① inside the refrigerator, a path ② of the vacuum space, and a path ③ outside the refrigerator. In the path ② of the vacuum space, since the effect of the conduction resistance due to the wrinkle pipe and the wrinkle pipe adiabatic material is large, a relatively low heat transfer state may be maintained.

FIG. 13 is a graph illustrating a temperature change according to the four cases.

The cases are divided with reference to FIG. 13. A case of an adiabatic wall using a thick foam is referred to as a. A case in which only the wrinkle pipe 90 is used is referred to as b. A case in which the wrinkle pipe 90 and the wrinkle pipe adiabatic material 80 according to an embodiment (referring to the case a in FIG. 11) is used is referred to as c. A case in which the wrinkle pipe 90 and the wrinkle pipe adiabatic material having the head on both ends (referring to the case of b in FIG. 11) is used is referred to as d.

In the horizontal axis length of the graph of FIG. 13, the path ② of the vacuum space may be based on 50 mm in the case of the foam and 20 mm in the case of the vacuum adiabatic body.

A temperature change curve according to each of the cases will be described.

In the case (a) of the adiabatic wall using the foam, a distance of the conduction path and a temperature change are proportional to each other. In the case (b) using only the wrinkle pipe, although the cool air loss is reduced by the adiabatic effect of the wrinkle pipe itself, it may be observed that the cool air loss is greater than the other two cases.

In the case (c) of the embodiment, when compared to the case (d) using the wrinkle pipe 90 and the wrinkle pipe adiabatic material having the heads at both the ends, there is the cool air loss. However, since a high temperature is maintained in the path ② of the vacuum space, cooling of the defrosting water may be prevented. In other words, the convective heating of the plate contacting the wrinkle pipe from the outside may be allowed to prevent the defrosting water from being cooled.

Also, in the case (c) of the embodiment, the cool air loss may be reduced due to the low thermal conduction when compared to the case (b) in which only the wrinkle pipe is used.

As a result, an operation in which a certain amount of heat is absorbed from the heat inside the refrigerator to the drain 72 to prevent the defrosted water from being frozen and an operation in which the head 81 is provided on the wrinkle pipe adiabatic material 80 only inside the refrigerator to prevent the air cold loss inside the refrigerator from occurring may be performed at the same time.

Hereinafter, another example of focusing on the viewpoint of fixing the drain will be described.

The contents described with reference to FIGS. 8 to 13 are applied to the following embodiments, but it is assumed that the description of other embodiments below is applied prior to portions that are not applicable.

Figure 14:
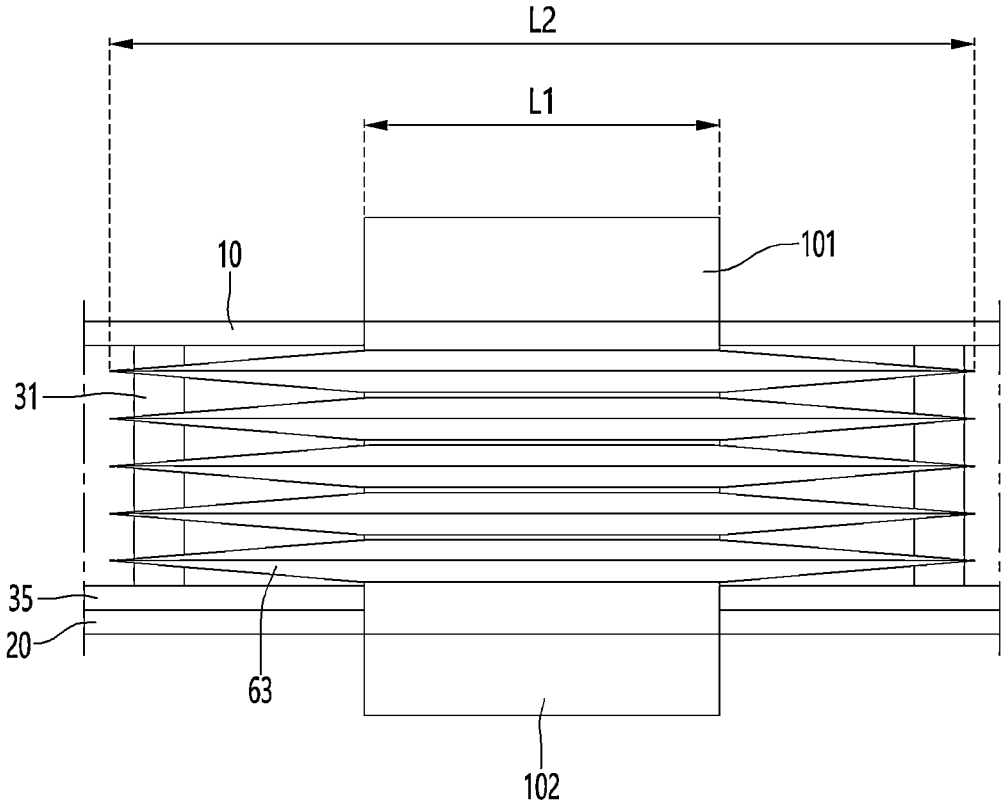
FIG. 14 is a cross-sectional view of a drain according to another embodiment.
Figure 15:
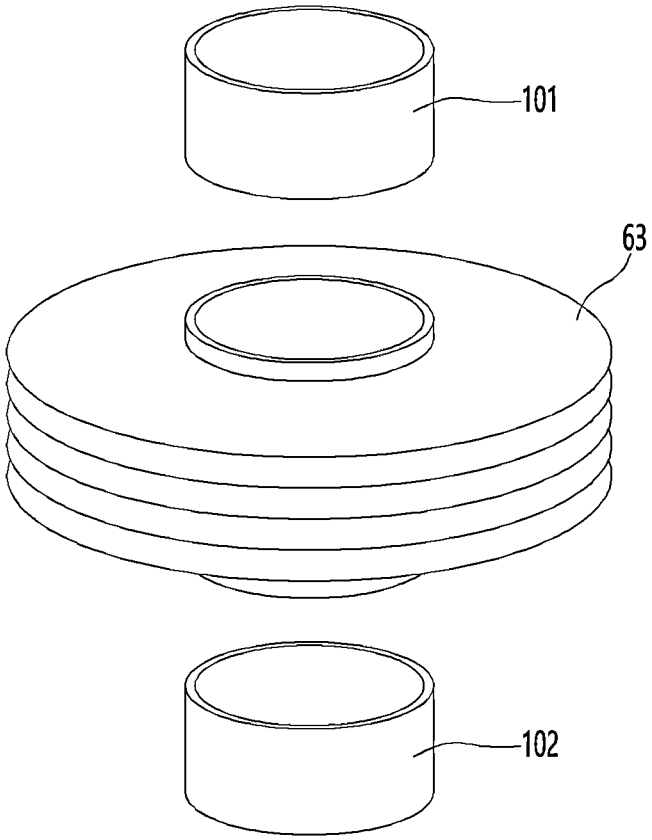
FIG. 15 is a view illustrating coupling of a wrinkle type conductive resistance sheet and a pipe.

FIG. 14 is a cross-sectional view of a drain according to another embodiment, and FIG. 15 is a view illustrating coupling of a wrinkle-type conductive resistance sheet and a pipe.

In FIGS. 14 and 15, the drain pipe 85 and the wrinkle pipe adiabatic material 80 are omitted, but may be included in the same manner as in the original embodiment.

Referring to FIGS. 14 and 15, a wrinkle-type conductive resistance sheet 63 is placed inside each of plates 10 and 20 in a vacuum space. A maximum diameter L2 of the wrinkle-type conductive resistance sheet 63 is larger than the opening of each of the plates 10 and 20. The wrinkle-type conductive resistance sheet 63 may not move inside the vacuum space.

When compared to the wrinkle pipe 90, the maximum diameter of the wrinkle-type conductive resistance sheet 63 is considerably large. Thus, the wrinkle-type conductive resistance sheet 63 may be produced in a custom-made method using welding or the like between the portions, and as a result, a high production cost may be required.

One side pipe 101 may be coupled to one side of the wrinkle-type conductive resistance sheet 63, and the other side pipe 102 may be coupled to the other side of the wrinkle-type conductive resistance sheet 63. A maximum diameter L2 of the wrinkle-type conductive resistance sheet 63 is considerably larger than a diameter L1 of each of the one side pipe 101 and the other side pipe 102. Here, the pipe may be configured to couple the wrinkle pipe and may be referred to as a coupling structure for the thin pipe. When the thin pipe has a separate coupling structure, a separate coupling structure such as a pipe may not be required.

A support plate 35 and a bar 31 providing a support 30 may be provided inside the vacuum space.

A wrinkle pipe adiabatic material 80 may be provided inside the wrinkle-type conductive resistance sheet 63 and on an inner surface of the first plate 10, like the original embodiment, and thus, convective heat transfer may be reduced.

Figure 16:
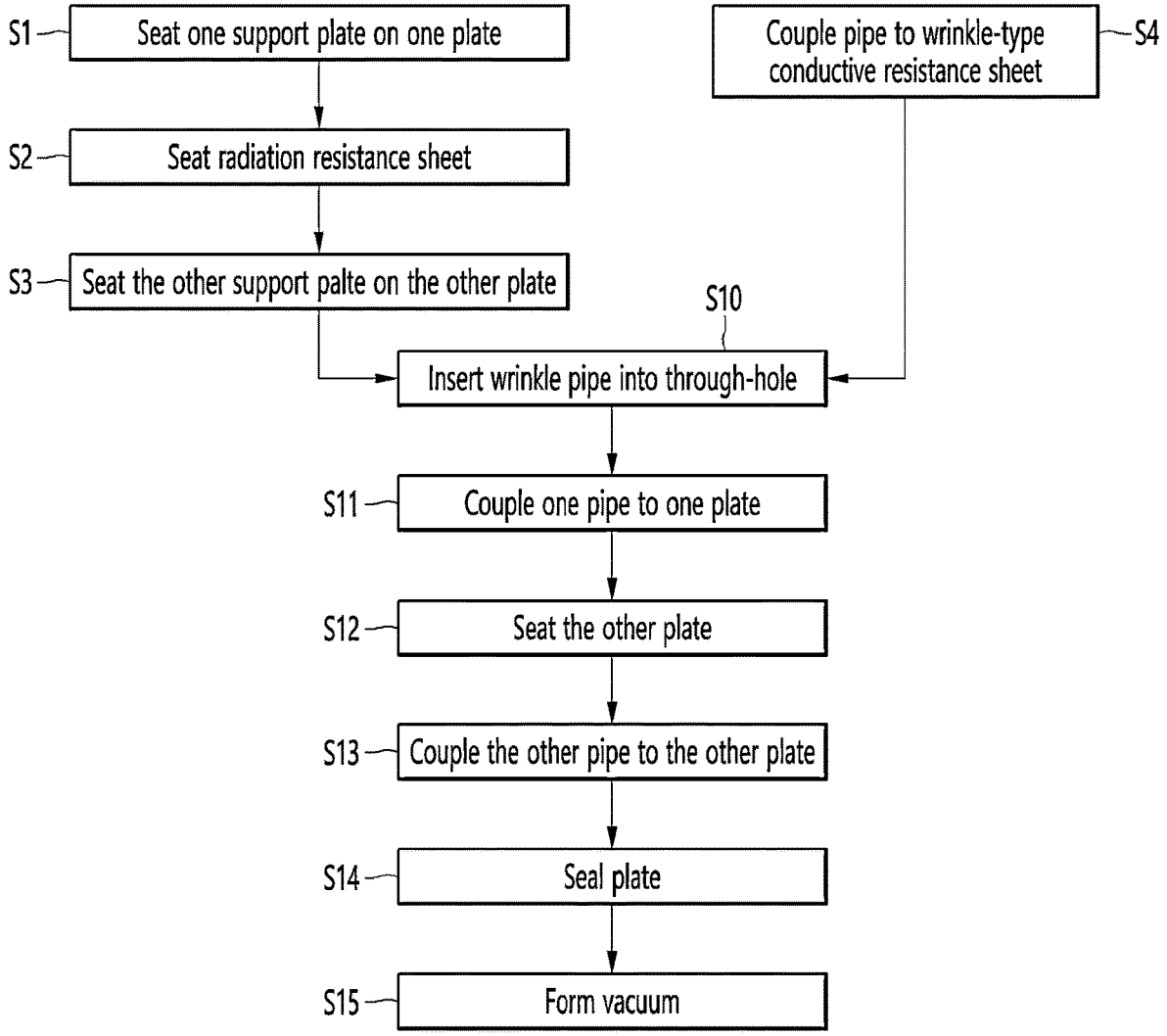
FIG. 16 is a flowchart for explaining a method for fabricating a refrigerator according to another embodiment.

FIG. 16 is a flowchart illustrating a method of manufacturing a refrigerator according to another embodiment, focusing on a method of manufacturing a drain of defrosting water, but is not limited thereto. That is, it is understood as a method of providing all pipelines passing through a vacuum adiabatic body.

Referring to FIG. 16, preparation processes (S1 to S3) of preparing a support 30 and plates 10 and 20 placed inside a vacuum space as a first process, and a process (S4) of coupling a wrinkle-type conductive resistance sheet 63 to pipes 101 and 102 as a second process are performed.

The first process will be described.

First, a support plate 35 disposed at one side is seated on the plates 10 and 20 disposed at one side (S1). Here, one side and the other side means any one of the portions that may be provided in a pair and do not have directionality. The same goes for the following.

A radiation resistance sheet 32 is seated on the one side support plate 35 (S2). The radiation resistance sheet 32 may be placed on the one side support plate 35 to be fixed without moving.

Thereafter, the other side support plate 35 may be seated to correspond to the one side support plate 35. The one side support plate and the other side support plate may be understood as portions corresponding to inner surfaces of the first and second plates, respectively.

In the second process, one side pipe 101 and the other side pipe 102 may be coupled to both opened ends of the wrinkle-type conductive resistance sheet 63 (S4). When this process is ended, a wrinkle-type assembly in which the pipe and the wrinkle-type conductive resistance sheet are integrated may be provided.

Thereafter, a third process in which the two portions are integrated is performed.

First, the wrinkle-type assembly may be seated and inserted into a through-hole of the one side plate (S10). The through-hole of the one side plate may have a diameter so that the pipe 101 is inserted and may be provided before the support plate is placed (S1), but is not limited thereto. Since the through-hole of the one-side plate is less than a maximum diameter of the wrinkle-type conductive resistance sheet, the wrinkle-type conductive resistance sheet may be fixed in position without being separated from the through-hole.

Thereafter, the inserted one side pipe 101 may be coupled to the one side plate 10 (S11). Here, both portions may be metal portions and be coupled to each other through welding or the like.

Thereafter, the other side plate 20 is seated so that the other side pipe 102 is inserted into the through-hole of the other side plate 20 (S12), and the other side pipe 102 and the other side plate 20 are coupled to each other (S13).

Here, even in the process (S12) in which the other side pipe 102 is seated on the other side plate 20, since the through-hole of the other side plate is less than the maximum diameter of the wrinkle-type conductive resistance sheet, the wrinkle-type conductive resistance shape may be fixed in position without being separated from the through-hole.

The coupling (S11 to S13) between the pipes 101 and 102 and the plates 10 and 20 may be performed in different manners.

For example, before the process (S11) of coupling the one side pipe 101 to the one side plate 10 by the method such as the welding, in a state in which only the one side pipe 101 and the one side plate 10 are seated, the other side pipe 102 and the other side plate 20 may also be seated (S12). Thereafter, the coupling (S11) of the one side pipe 101 and the one side plate 10 and the coupling (S13) of the other side pipe 102 and the other side plate 20 may be completed.

Also, the coupling of the one side pipe 101 and the one side plate 10, and the coupling of the other side pipe 102 and the other side plate 20, i.e., the two coupling processes may be performed at once or may be performed separately.

The wrinkle-type conductive resistance sheet 63 having the pipe in the pair of plates 10 and 20 may be accurately positioned through the above-described processes.

Thereafter, the pair of plates 10 and 20 are sealed to each other (S14), and air may be drawn out to create an inner vacuum space (S15).

In the above embodiment, if there is an integrated boss enough to overlap the plate at an end of the wrinkle-type conductive sheet, the pipes 101 and 102 may not be used as separate components but may be fixed in position relative to the plates. However, to deform a shape that is enough to change the maximum diameter and the minimum diameter of the wrinkle-type conductive resistance sheet, a separate pipe may be applied because of difficulty in processing.

Hereinafter, another embodiment will be described in which the viewpoint of fixing the drain is mainly observed. The contents described with reference to FIGS. 8 to 13 are applied to the following embodiments, but it is assumed that the description of other embodiments below is applied prior to portions that are not applicable.

Figure 17:
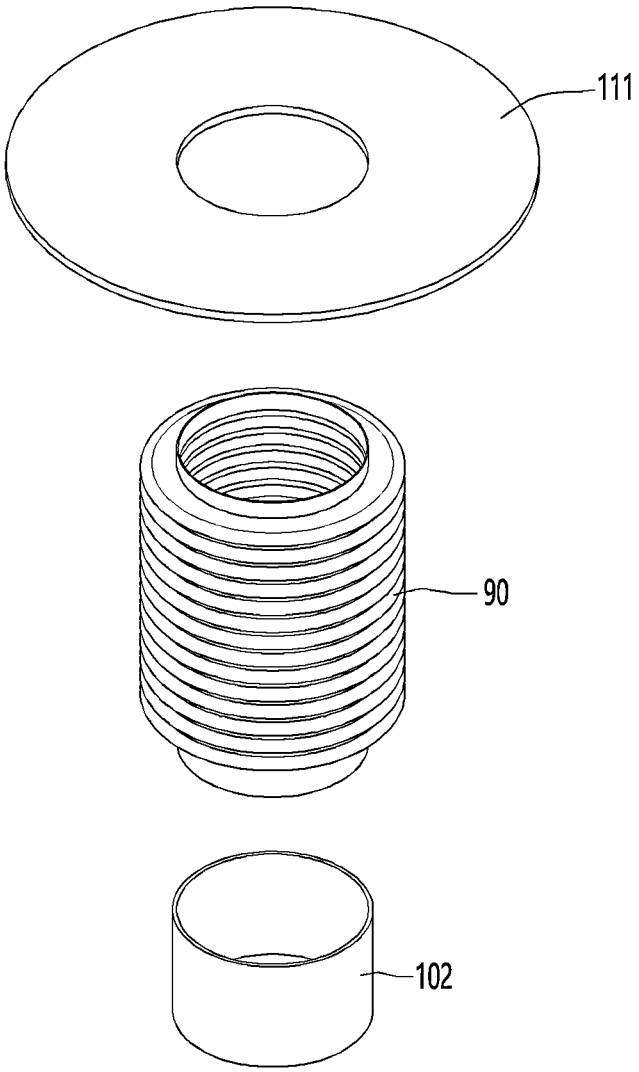
FIG. 17 is a view illustrating a wrinkle pipe and a portion coupled to each of both ends of the wrinkle pipe according to another embodiment.
Figure 18:
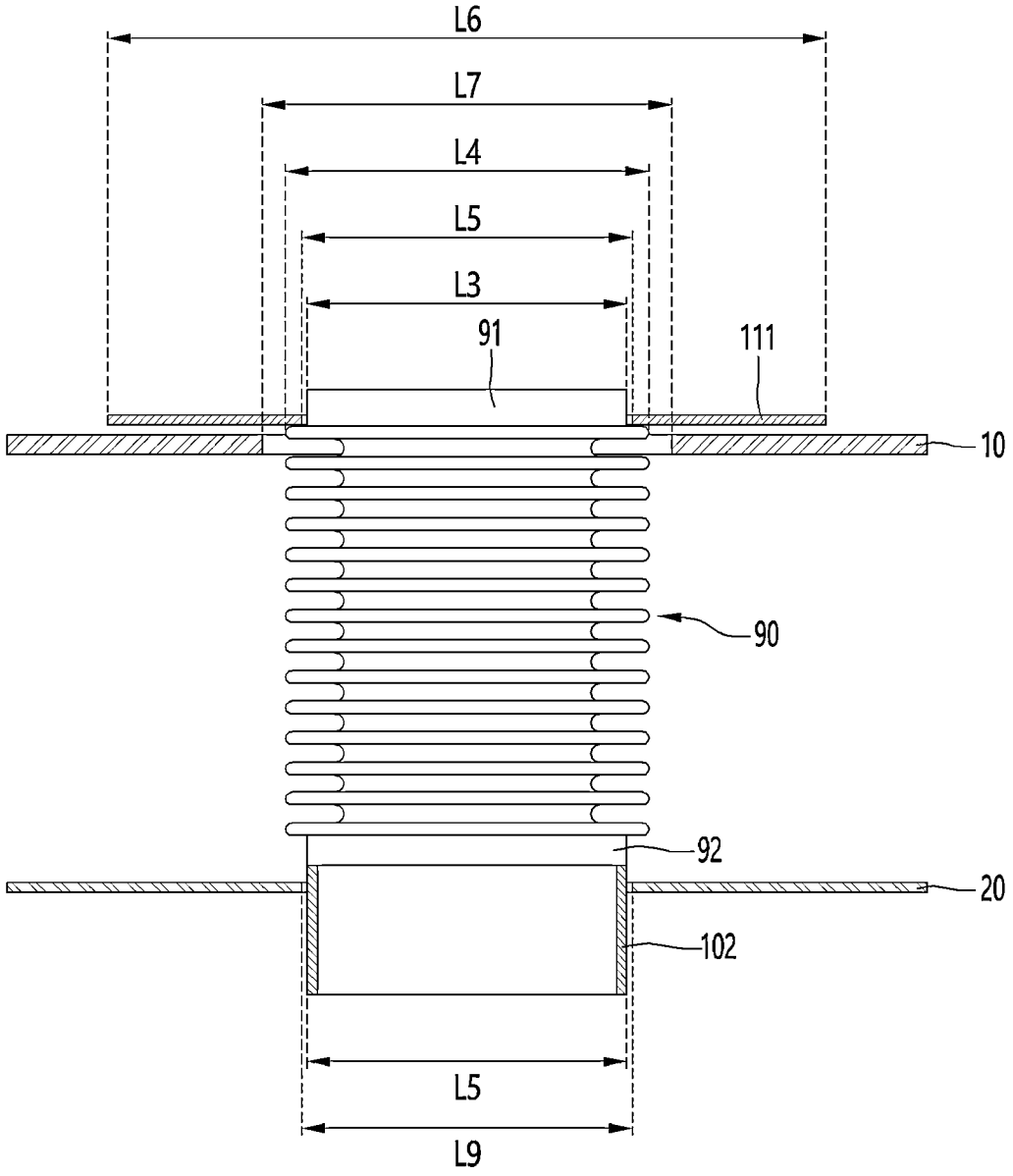
FIG. 18 is a cross-sectional view of a drain according to further another embodiment.

FIG. 17 is a view illustrating a wrinkle pipe and a portion coupled to each of both ends of the wrinkle pipe according to another embodiment, and FIG. 18 is a cross-sectional view of a drain according to another embodiment.

In FIGS. 17 and 18, the drain pipe 85 and the wrinkle pipe adiabatic material 80 are omitted, but may be assumed to be included in the same manner as in the original embodiment.

Referring to FIGS. 17 and 18, a guide plate 111 may be coupled to one side of the wrinkle pipe 90, and the other side pipe 102 may be coupled to the other side of the wrinkle pipe 90.

As may be clearly understood through the above description, the wrinkle pipe 90 may be provided to a maximum diameter less than that of the wrinkle-type conductive resistance sheet 63. As a result, the wrinkle pipe 90 may be more conveniently and simply mounted on the vacuum adiabatic body.

A structure of the drain according to another embodiment will be described in detail.

One side of the wrinkle pipe 90 may be coupled to the first plate 10, and the other side of the wrinkle pipe 90 may be coupled to the second plate 10. One side of the wrinkle pipe 90 may be indirectly coupled to the first plate 10 in a state in which the guide plate 111 is coupled. The other side of the wrinkle pipe 90 may be coupled directly or indirectly to the second plate 20 in a state in which the other side pipe 102 is coupled.

A through-holes of the first plate and a through-holes of the second plate may have different diameters. This is because it is difficult to manage an alignment dimension of the two through-holes in a production process of a product. In other words, no matter how precise the position is, quality of the product may be affected because misaligned positions occur in the two through-holes in spite of the small diameter.

To prevent this phenomenon, according to another embodiment, the through-hole of the first plate 10 may be greater than the through-hole of the second plate 20. When the two plates 10 and 20 are aligned vertically, an area of the through-hole of the first plate 10 includes an entire area of the through-hole of the second plate 20.

Accordingly, even if the position is slightly distorted after the plate 10 and 20 are fabricated, the guide plate 111 may close the through-hole of the first plate 10 in the state in which the wrinkle pipe 90 is seated on the second plate 20. Thus, there is no problem in mounting the wrinkle pipe 90 and sealing the vacuum space.

To provide the above-described configuration and operation, a diameter of each portion providing the drain may have the following mutual relation.

First, an outer diameter L6 of the guide plate 111 may be provided to be greater than a diameter L7 of the through-hole of the first plate 10. Accordingly, the guide plate 111 may achieve the sealing between the plates.

The diameter L7 of the through-hole of the first plate 10 may be provided to be greater than or equal to a maximum diameter L4 of the wrinkle pipe. Accordingly, the wrinkle pipe 90 may be mounted into the vacuum space in the state in which the plates 10 and 20 are coupled. Of course, the diameter L7 of the through-hole of the first plate 10 may be provided to the same maximum diameter L4 of the wrinkle pipe. However, due to convenience of fabrication and the characteristics of the portion made of a metal, the diameter L7 of the through-hole of the first plate 10 may be slightly greater than the maximum diameter L4 of the wrinkle pipe.

An inner diameter L8 of the guide plate 111 may be provided to be less than the maximum diameter L4 of the wrinkle pipe and greater than a diameter L3 of an end of the wrinkle pipe 90. Accordingly, the guide plate 111 may be supported by being hooked with the end of the wrinkle pipe. Here, the diameter of the end of the wrinkle pipe may be referred to as its outer diameter.

The diameter L3 of the end of the wrinkle pipe 90 may be provided to be equal or greater than the diameter L5 of the other side pipe 102. Accordingly, the coupling of the wrinkle pipe and the other side pipe may be easily performed.

A diameter L9 of the through-hole of the second plate may be provided to be greater than each of the diameter L3 of the end of the wrinkle pipe and the diameter of the other side pipe 102. Accordingly, the wrinkle pipe 90 may be coupled to the second plate 20. Of course, for reliable welding between the portions in the future, the diameter L9 of the through-hole of the second plate may be provided to be less than the maximum diameter L4 of the wrinkle pipe. Accordingly, it is possible to improve the convenience of the sealing. Furthermore, the diameter L9 of the through-hole of the second plate is not provided too large, so that a distance between both the portions decreases as much as possible. Accordingly, it is desirable to increase in reliability of the sealing operation through the welding or the like.

On the other hand, for example, the place to which the other side pipe 102 is coupled may be the second plate 20 of the first and second plates 10 and 20, i.e., the plate providing at least a portion of the wall in the space inside the refrigerator. The reason is that it is preferable to guide the withdrawal of the drain pipe by a predetermined length and to eliminate the additionally protruding pipe because the space inside the refrigerator is narrow.

Without being limited thereto, the other side pipe 102 may be installed on the inside of the refrigerator, that is, on the first plate 10. In this case, an increase in cool air transfer to the wrinkle pipe, which is generated when the guide plate 111 is installed inside the refrigerator may be suppressed. In other words, when the guide plate 111 is installed inside the refrigerator, a thickness of the portion that is heat-conducted as much as the guide plate 111 may increase in thickness at a place that is aligned vertically with the head 81 of the wrinkle pipe adiabatic material.

In this case, there is a disadvantage that the reduction in cool air loss due to the convective heat transfer, which may be obtained by the head 81 of the wrinkle pipe adiabatic material, may be lowered, but when the guide plate is thinly provided, it may be ignored because capacity of the cool air conduction is reduced.

Figure 19:
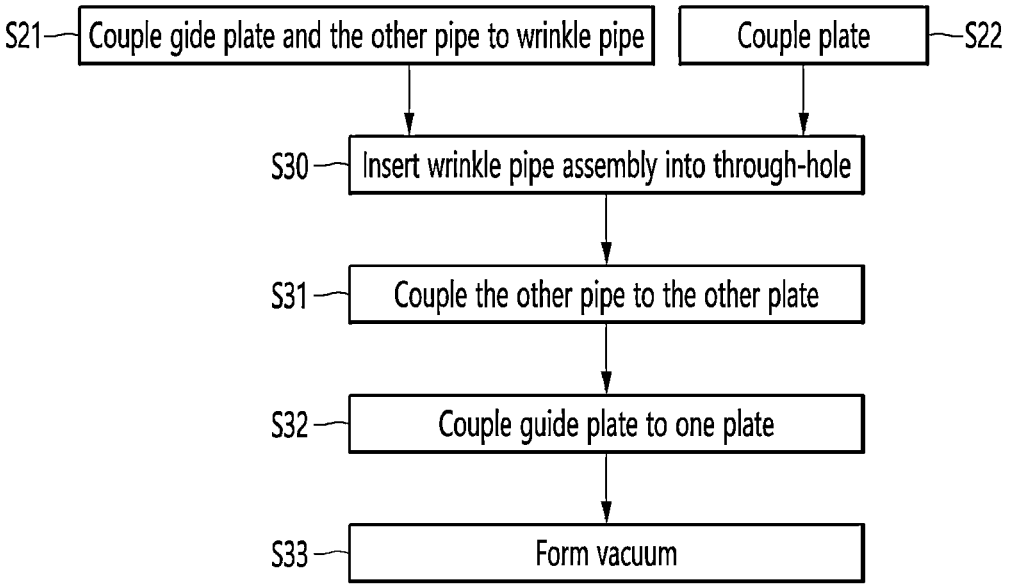
FIG. 19 is a flowchart for explaining a method for fabricating a refrigerator according to another embodiment.

FIG. 19 is a flowchart illustrating a method of manufacturing a refrigerator according to further another embodiment, focusing on a method of manufacturing a drain of defrosting water, but is not limited thereto. That is, it is understood as a method of providing all pipelines passing through a vacuum adiabatic body.

Referring to FIG. 19, as a first process, a guide plate 111 and the other side pipe 102 are coupled to a wrinkle pipe 90 (S21), and as a second process, in a state in which portions within a vacuum space such as a support 30 and the like are accommodated, a process of coupling plate members 10 and 20 is performed (S22). A wrinkle pipe assembly is provided as a product of the first process.

The first process and the second process may be performed at different times in separate places, like another embodiment.

The wrinkle pipe assembly may be inserted into a through-hole of the plate (S30). When the wrinkle pipe assembly is inserted into the through-hole of each of the plates 10 and 20, the other side pipe 102 may be inserted first into the first plate 10 (S30). The insertion of the wrinkle pipe assembly may be performed until the guide plate 111 is hooked and supported on an inner surface of the first plate 10. Since the through-hole of the first plate 10 is greater than the wrinkle pipe, the wrinkle pipe assembly may be easily inserted.

In the state in which the guide plate 111 is seated on the first plate 10, preferably, the through-hole of the second plate 20 may match a center of the other side pipe 102. On the other hand, a center of the guide plate 111 and a center of the through-hole of the first plate 10 may not match each other. Nevertheless, the coupling between the portions may be easily performed as already described.

Thereafter, the other side pipe 102 and the second plate 20 may be coupled to each other (S31). Thereafter, the guide plate 111 and the first plate 10 may be coupled to each other (S32).

In the coupling operation of the wrinkle pipe, the coupling process (S32) with the first plate is performed later than the coupling process (S31) with the second plate. The reason is that during the coupling process (S31) with the second plate, displacement may occur in the wrinkle pipe, and in this case, the displacement may be absorbed by allowing the guide plate 111 to move.

On the other hand, when the coupling process (S32) with the first plate is performed first, the other side pipe 102 may not absorb the displacement. Thus, the displacement of the wrinkle pipe remains in the wrinkle pipe, which may lead to deterioration and breakage of the product.

Thereafter, a sealing operation of the drain 72 is completed, and a vacuum may be generated inside the vacuum adiabatic body to terminate the operation (S33).

In this embodiment, it is seen that, even if the dimensions of each portion and the mutual positions between components do not exactly match, an accurate assembly operation is completed. This embodiment is due to the intrinsic limitation of the product in which the performance of the vacuum adiabatic body is not exerted because of leading to the vacuum destruction even by the assembly defects due to small errors.

INDUSTRIAL APPLICABILITY

According to the embodiments, it is possible to improve the product reliability of the drain that leads the defrosting water of the evaporator disposed inside the refrigerator to the outside by providing the pipe passing through the inside and outside of the vacuum adiabatic body.

According to the embodiments, since the objectives of securing semi-permanent reliability of the vacuum adiabatic body, reducing the heat loss, and preventing the failure due to the freezing of the pipeline fluid are achieved, it may be said that its application is urgently expected in the refrigerator industry.

Embodiments provide a refrigerator in which a cool air loss through a thin gap passing through a vacuum adiabatic body is reduced.

Embodiments also provide a refrigerator in which a conduction cooling loss between portions due to high thermal conductivity of a metal structure constituting a vacuum adiabatic body is reduced.

Embodiments also provide a refrigerator in which defrosting water due to a small thickness of a vacuum adiabatic body is prevented from being frozen to prevent a product from being broken down.

Embodiments also provide a refrigerator in which dew is prevented from being generated around a metal structure due to a temperature change during a defrosting operation of the refrigerator to improve reliability of a product.

Technical Solution

In one embodiment, a vacuum adiabatic body includes: a thin pipe configured to connect an opening of the first plate to an opening of the second plate, the thin pipe being configured to define at least a portion of a wall of a third space of the plate; and an adiabatic material having an extension provided inside the thin pipe to perform an adiabatic operation with respect to the thin pipe and a head provided on an end of the extension at at least one side of the first plate and the second plate, wherein defrosting water passes through an inside of the adiabatic material.

A through pipeline passing through an inside of the adiabatic material to allow a material to pass between a first space and the second space may be further provided to allow the defrosting water to pass without being frozen.

The head may prevent the plates from being exposed to a space defined by each of the plates to prevent thermal conduction between the head and the plates from occurring.

The thin pipe may be a wrinkle pipe, and the wrinkle pipe may have a cross-section including: two vertical portions; two horizontal portions; and a rounded extension distance portion disposed between the two vertical portions and the two horizontal portions. Thus, a thermal conduction transfer amount may be reduced while using an inexpensive component that are capable of mass production to reduce a price of an adiabatic product using the vacuum adiabatic body.

The first space may have a low temperature compared to the second space, the head may be provided at a side of the first plate, and the head may be configured to block exposure of an adjacent portion of the opening of the first plate to the first space so as to interrupt convection cooling of the adjacent portion of the opening of the first plate. Thus, a cool air loss from a low-temperature space of a side of the first plate may be reduced. Here, the head may not be provided at a side of the second plate to allow heat to be transferred from a high-temperature side, thereby preventing a product from being damaged by the defrosting water and moisture of the peripheral portion thereof.

A pipe may be coupled to one side of the thin pipe to provide an equipment that is convenient for mass production and product application.

A guide plate may be coupled to one side or both sides of the thin pipe so that coupling and assembly of the guide plate is more simply. Here, when the opening of the plate corresponding to the one side of the thin pipe to which the guide plate is coupled is larger than the opening of the other plate, a worker may more simply mount a drain structure of the defrosting water. Alternatively, it may be possible to prolong a product lifespan by preventing a product failure and suppressing a stress occurrence.

In another embodiment, a refrigerator includes: a drain provided in a main body to discharge defrosting water generated in an evaporator to an outside of an accommodation space, wherein the drain includes: a thin pipe; a drain pipe provided inside the thin pipe to discharge the defrosting water; and an adiabatic material having an extension extending along the drain pipe to block heat transfer between the drain pipe and the thin pipe and a head provided at only one side of both sides of the extension, which is close to the accommodation space. Since the head is provided at only the one side, a convection operation in both directions may be balanced, and thermal equilibrium within the extension may be achieved. Cooling of the defrosting water and moisture in the peripheral portion may be suppressed, and leakage heat may be reduced.

The head may block convection cooling between the accommodation space and the wall surface of the accommodation space as the accommodation space is in close contact with the wall surface. Thus, the cooling leakage due to convection transmission may be prevented.

Convection heating of the thin pipe may be allowed on the other side of the extension, which is far from the accommodation space. Thus, external heat may be used as heat for dissolving the defrosting water.

The main body may use the vacuum adiabatic body, and the thin pipe may include an extension distance portion to increase in heat conduction distance, thereby reducing the heat conduction between the plate. Thus, it is possible to reduce an amount of conduction heat transfer flowing to the inside and outside of the vacuum adiabatic body.

The thin pipe may include: a main body including at least two extension distance portions; and a coupling portion coupled to each of the plates at an end of the main body to increase in distance for the conduction heat transfer.

In further another embodiment, a method for fabricating a refrigerator including a vacuum adiabatic body, which includes a thin pipe and is used as a main body, includes: providing a coupling structure to at least one side of the thin pipe; fixing the one side of the thin pipe to one of the plates; and fixing the other side of the thin pipe to the other one of the plates. Thus, a portion passing through the vacuum adiabatic body may be conveniently mounted in the refrigerator without being broken down.

A guide plate may be coupled to the other side of the thin pipe to more conveniently insert the portion into the vacuum adiabatic body.

The opening of the plate corresponding to the other side of the thin pipe may be larger than the opening of the plate corresponding to the one side of the thin pipe so that the portion is more easily inserted into one side.

The guide plate may have an outer diameter greater than that of the opening of the plate corresponding to the other side of the thin pipe to allow the guide plate to be hooked.

The thin pipe may include a main body having a plurality of wrinkles, and the coupling structure may be a pipe coupled to both ends of the main body. Thus, the portion that is capable of mass production may be used inexpensively.

Before the other side of the thin pipe and the other one of the plates are coupled to each other, the pair of plates may be coupled to each other. Thus, it may have an advantage of smoothing the supply and demand of components and a flow of manufacturing sites.

After the one side of the thin pipe is fixed to the one of the plates, the pair of plates may be coupled to each other. Thus, it may have an advantage of smoothing the supply and demand of components and a flow of fabricating sites.

Advantageous Effects

According to the embodiment, it may be possible to reduce the convective heat loss leaking through the discharge structure of the defrosting water provided as the thin wall.

According to the embodiment, the conduction cooling loss between the portions due to the high thermal conductivity of the metal structure constituting the vacuum adiabatic body may be reduced.

According to the embodiment, it may be possible to prevent the freezing that may occur in the discharge passage of the narrow defrosting water by the cool air permeation, thereby preventing the product from being broken down.

According to the embodiment, it may be possible to prevent the occurrence of the dew around the metal structure due to the temperature change during the defrosting operation of the refrigerator and to improve the reliability of the product, and to prevent the failure of the product due to the freezing of the generated dew.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum adiabatic body, comprising:
- a first plate having a first opening;
- a second plate having a second opening;
- a vacuum space provided between the first plate and the second plate;
- a pipe configured to connect the first opening to the second opening; and
- an adiabatic material comprising:
  - a single head that is disposed at the first plate and is not disposed at the second plate; and
  - an extension that extends from the single head and comprising:
    - a first part that is disposed in the first opening and is provided inside the pipe;
    - a second part that is disposed in the second opening and is provided inside the pipe; and
    - a third part that connects the first part and the second part and is provided inside the pipe,
- wherein an outer diameter of the single head is greater than an outer diameter of an outer circumferential surface of the pipe.

2. The vacuum adiabatic body according to claim 1, further comprising a pipeline to pass through the first and second openings and configured to allow a material to pass therein,
- wherein the first part surrounds a first portion of the pipeline, the second part surrounds a second portion of the pipeline, and the third part surrounds a third portion of the pipeline, and
- wherein the third part includes an inner circumferential surface contacting the pipeline.

3. The vacuum adiabatic body according to claim 2, wherein the inner circumferential surface and an outer circumferential surface of the adiabatic material are provided between an outer circumferential surface of the pipeline and an inner circumferential surface of the pipe configured to connect the first opening to the second opening.

4. The vacuum adiabatic body according to claim 2, wherein the single head, the first part, the second part and the third part of the extension form a hole through which the pipeline passes.

5. The vacuum adiabatic body according to claim 2, wherein the third part is provided between the pipe and the third portion of the pipeline, and wherein the third part includes an outer circumferential surface contacting the pipe.

6. The vacuum adiabatic body according to claim 1, wherein the first part, the second part, and the third part of the extension pass through the first opening and the second opening.

7. The vacuum adiabatic body according to claim 1, wherein a size of the single head is greater than a size of the first opening to allow the single head to shield a portion of the first plate.

8. The vacuum adiabatic body according to claim 1, wherein the first plate is spaced apart from the second plate in a first direction, and wherein a thickness of the single head in the first direction is greater than a thickness of the first plate or the second plate in the first direction.

9. The vacuum adiabatic body according to claim 1, wherein the first plate is configured to define at least a portion of a wall for a first space, wherein the second plate is configured to define at least a portion of a wall for a second space, and wherein the single head is disposed in the first space.

10. The vacuum adiabatic body according to claim 9, wherein the second part of the extension comprises an end that is exposed to the second space.

11. The vacuum adiabatic body according to claim 1,
- wherein the pipe comprises a wrinkle pipe, and
- wherein the wrinkle pipe comprises:
  - at least two vertical portions extending in a direction to correspond the part of the extension; and
  - at least two horizontal portions provided between the at least two vertical portions to extend in a direction away from the part of the extension.

12. The vacuum adiabatic body according to claim 11, wherein the wrinkle pipe comprises a round extension to connect the at least two horizontal portions and having a diameter greater than a separation distance of the at least two horizontal portions.

13. A refrigerator, comprising the vacuum adiabatic body according to claim 1.

14. A vacuum adiabatic body, comprising:
- a first plate configured to define at least a portion of a wall for a first space and having a first opening;
- a second plate configured to define at least a portion of a wall for a second space and having a second opening;
- a vacuum space provided between the first plate and the second plate;
- a pipe configured to connect the first opening to the second opening;
- a single head including a first surface supported by the first plate; and
- an extension that extends from the single head and includes a part provided inside of the pipe, wherein the pipe comprises:
  - first portions that extend in a first direction from the first plate to the second plate and contact the part of the extension; and
  - second portions that extend in a different direction from the first direction and each provided between one of the first portions and another of the first portions, wherein the second portions extend in a direction away from the part of the extension and are spaced apart from each other,
- wherein an outer diameter of the single head is greater than an outer diameter of an outer circumferential surface of the pipe.

15. The vacuum adiabatic body according to claim 14, wherein the extension is provided inside of the pipe, and wherein a portion of a pipeline is received in the extension.

16. The vacuum adiabatic body according to claim 14, wherein an inner diameter of the extension is less than a diameter of the first opening of the first plate.

17. A refrigerator, comprising the vacuum adiabatic body according to claim 14.

18. A vacuum adiabatic body, comprising:

a first plate having a first opening;

a second plate having a second opening;

a vacuum space provided between the first plate and the second plate;

a pipe configured to connect the first opening to the second opening and including an inner circumferential surface defining an inner diameter and an outer circumferential surface defining an outer diameter;

a pipeline to pass through the first and second openings and configured to allow a material to pass therein; and a guide plate to couple to a first end of the pipe and having a hole connected to the first opening of the first plate, wherein an outer diameter of the guide plate is greater than the outer diameter of the outer circumferential surface of the pipe.

19. The vacuum adiabatic body according to claim 18, wherein the first plate is spaced apart from the second plate in a first direction, and wherein a thickness of the guide plate in the first direction is less than a thickness of the first plate or the second plate in the first direction.

20. A refrigerator, comprising the vacuum adiabatic body according to claim 18.

* * * * *